US006727784B2

(12) United States Patent
Endou et al.

(10) Patent No.: US 6,727,784 B2
(45) Date of Patent: Apr. 27, 2004

(54) DIELECTRIC DEVICE

(75) Inventors: Kenji Endou, Tokyo (JP); Kouji Tashiro, Tokyo (JP); Osamu Takubo, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/259,504

(22) Filed: Sep. 30, 2002

(65) Prior Publication Data

US 2003/0062973 A1 Apr. 3, 2003

(30) Foreign Application Priority Data

Sep. 28, 2001 (JP) ..... 2001-302513

(51) Int. Cl.[7] ..... H01P 1/20
(52) U.S. Cl. ..... 333/206; 333/202; 333/134
(58) Field of Search ..... 333/206, 202, 333/134, 135, 136, 222, 236, 125

(56) References Cited

U.S. PATENT DOCUMENTS

| | | | | |
|---|---|---|---|---|
| 4,985,690 A | | 1/1991 | Eguchi et al. | |
| 5,614,875 A | | 3/1997 | Jang et al. | |
| 5,818,312 A | * | 10/1998 | Noguchi et al. | 333/202 |
| 5,841,331 A | * | 11/1998 | Tsujiguchi | 333/202 |
| 6,014,067 A | * | 1/2000 | Matsumoto et al. | 333/202 |
| 6,235,341 B1 | * | 5/2001 | Hino | 427/126.2 |
| 6,304,158 B1 | * | 10/2001 | Nishijima et al. | 333/206 |
| 2001/0000429 A1 | | 4/2001 | Arakawa et al. | |
| 2002/0030559 A1 | * | 3/2002 | Hiroshima et al. | 333/134 |

FOREIGN PATENT DOCUMENTS

| | | |
|---|---|---|
| EP | 0 654 841 A | 5/1995 |
| EP | 0 899 806 A | 3/1999 |
| JP | 02-038804 | 3/1990 |
| JP | 05-275904 | 10/1993 |
| JP | 7-312505 | 11/1995 |

* cited by examiner

*Primary Examiner*—Brian Young
*Assistant Examiner*—John Nguyen
(74) *Attorney, Agent, or Firm*—Oblon, Spivak, McClelland, Maier & Neustadt, P.C.

(57) ABSTRACT

The present invention relates to a dielectric device that is suitable for miniaturization and height reduction and is surface-mountable. In a resonator unit Q1, a first hole 41 is provided to a dielectric substarate 1, extends from a surface 21 toward a surface 22 opposite thereto, opens in the surface 21, and has a first internal conductor 61 in the interior. A second hole 51 is provided to the dielectric substarate 1, opens in a surface 23 adjacent to the surface 21, extends from the surface 23 toward a surface 24 opposite thereto, and is connected with the first hole 41 in the interior of the dielectric substarate 1. The second hole 51 has a second internal conductor 81 in the interior, and the second internal conductor 81 is connected to the first internal conductor 61 in the interior of the dielectric substarate 1.

28 Claims, 28 Drawing Sheets

DIELECTRIC DEVICE

BACKGROUND OF THE INVENTION

1. Field of the Invention

The present invention relates to a dielectric resonator, and also to dielectric devices such as dielectric filters or duplexers composed therefrom.

2. Description of the Related Art

Such dielectric devices are used in high-frequency range such as sub-microwave band, microwave band, millimeter wave bands, and sub-millimeter wave band. More specific examples of applications include satellite communication devices, mobile communication devices, wireless communication devices, high-frequency communication devices, or base stations for such communication devices.

In conventional practice, resonators and dielectric filters used in portable phones and the like are commonly structured by combining a plurality of resonating components having one through-hole provided to a dielectric substarate, and the resonator length is commonly obtained by dividing a quarter of a wavelength $\lambda$ of the free space by the square root of the relative dielectric constant of the material constituting the dielectric substarate.

When composing a dielectric filter, either a plurality of resonators is connected by a separately prepared coupled circuit, or a plurality of through-holes is provided from one side to the exterior of an approximately rectangular dielectric substarate, the external surfaces excluding the open surface and the interiors of the through-holes are metallized, and the through-holes are fashioned into resonating components.

In the case of a dielectric filter that uses the dielectric substarate, an additional device such as a capacitor is added to the resonating component and a conductive pattern is formed on the open surface, yielding an additional element. Furthermore, by forming a groove, recess, or the like on the dielectric substarate itself, the balance of the electromagnetic coupling distribution is intentionally upset, and a configuration such as one coupled by an electric field or a magnetic field can be employed.

However, with conventional resonators and dielectric filters, when the goal is to shorten the resonator length in order to miniaturize the device, the load capacity must be formed separately, as described above, and configurations in which an additional device has been added to the resonator have a large number of components and are unsuitable for miniaturization.

Furthermore, with configurations in which a capacitor or the like is formed on the open surface of the resonator according to the conductor pattern, a complex and accurate conductive pattern must be formed on the open surface of the dielectric substarate, and miniaturization and height reduction will increase manufacturing costs and adversely affect the yield rate.

SUMMARY OF THE INVENTION

One of the features of the present invention is to provide a dielectric device suitable for miniaturization and height reduction.

Another feature of the present invention is to provide a surface-mountable dielectric device.

In order to achieve the above-described features, the dielectric device relating to the present invention comprises a dielectric substarate and at least one resonator unit. The dielectric substrate has an external conductor film on a first surface and other external surfaces.

The resonator unit comprises a first hole and a second hole. The first hole is provided to the dielectric substarate, has one end being open in the first surface, and extends from the first surface toward an external surface opposite thereto. The first hole has a first internal conductor in the interior, the first internal conductor being separated from the external conductor film on the first surface by a gap.

The second hole is provided to the dielectric substarate, has one end being open in an external surface not opposing the first surface, and is connected with the other end of the first hole in the interior of the dielectric substarate. The second hole also has a second internal conductor in the interior. One end of the second internal conductor is connected to the first internal conductor in the interior of the dielectric substarate, and the other end is connected to the external conductor film.

As described above, in the dielectric device relating to the present invention, the resonator unit comprises a first hole and a second hole, wherein a new hole configuration can be obtained in which the second hole intersects with the first hole at the other end opposing the open end.

In this new hole configuration, the first internal conductor provided to the first hole and the second internal conductor provided to the second hole are mutually connected.

Since the first internal conductor of the first hole faces the external conductor film via a dielectric layer composed of the dielectric substarate, a large electrostatic capacitance is generated between the first internal conductor film and the external conductor film. Therefore, the dielectric device relating to the present invention resonates at a frequency that is less than the electric length in relation to the length of the dielectric substarate, as seen from the axial direction of the second hole. In other words, miniaturization and height reduction can be achieved by shortening the length of the dielectric substarate in order to obtain the desired resonant frequency.

The dielectric device relating to the present invention can be used as an device with extensive coverage for a resonator, an oscillator, a dielectric filter, or a duplexer (also referred to as a antenna duplexer). The device may be completed with one resonator unit when used as a resonator. The device features a plurality of resonator units when used as a dielectric filter or duplexer.

When the device is used as a dielectric filter or duplexer, in addition to the length of the dielectric substarate being reduced for the aforementioned reasons, the interval between the first holes in two adjacent resonator units can be used to create capacitive coupling between the adjacent resonator units. Moreover, the capacitive coupling can be adjusted to the desired degree of coupling by adjusting the interval between the first holes in two adjacent resonator units. The electric coupling between adjacent resonator units can also be adjusted by either removing or adding conductors in the vicinity of the opening of the first internal conductor.

An inductive coupling can be substantially created between two adjacent resonator units using the capacitance between the first hole and the external conductor film provided to the dielectric substarate. This inductive coupling can also be adjusted to have the desired degree of inductive coupling by adjusting the interval between the first hole and the external conductor film provided to the dielectric substarate.

Furthermore, the device comprises a first terminal and a second terminal when used as a dielectric filter, and these terminals are used as input/output terminals. The first terminal can be provided at a position opposing the first hole provided to one of the resonator units via a dielectric layer of the dielectric substarate. The second terminal is provided at a position opposing the first hole provided to another resonator unit via a dielectric layer. Both the first and second terminals are insulated from the external conductor.

According to the previously described structure, the first and second terminals are capable of being mounted on a mount board. The first and second terminals may be provided to the external surface, provided to the first surface, or provided extending over two adjacent surfaces. Furthermore, the first and second terminals may be provided such that they form a capacitive coupling with the second internal conductor.

The device comprises at least three resonator units and first through third terminals when used as a duplexer. The first through third terminals are affixed to different resonator units and are used as an antenna connection terminal, a receiver terminal, and a transmitter terminal. According to the previously described structure, the first through third terminals are capable of being mounted on a mount board.

Additional objects, structures, and merits of the present invention are described in further detail with reference to the accompanying drawings. It is apparent, however, that the technological scope of the present invention is not limited to the illustrated embodiments.

DESCRIPTION OF THE PREFERRED EMBODIMENTS

Figure 1:
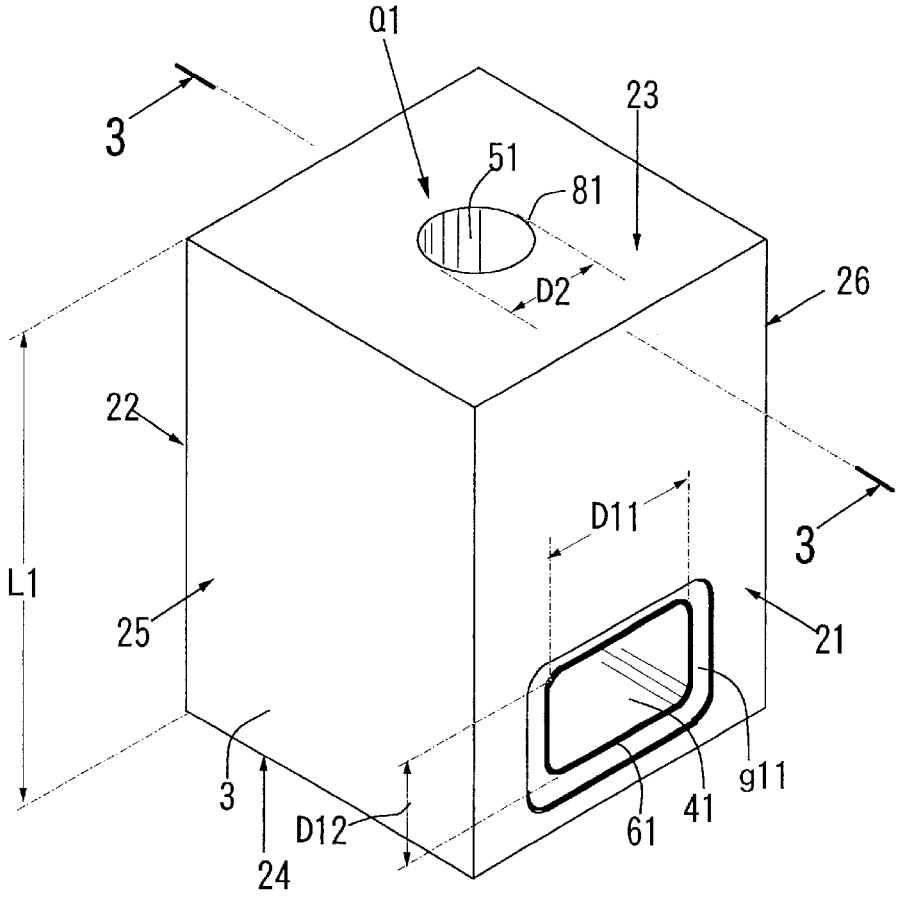
FIG. 1 is a perspective view of a dielectric resonator relating to the present invention.
Figure 2:
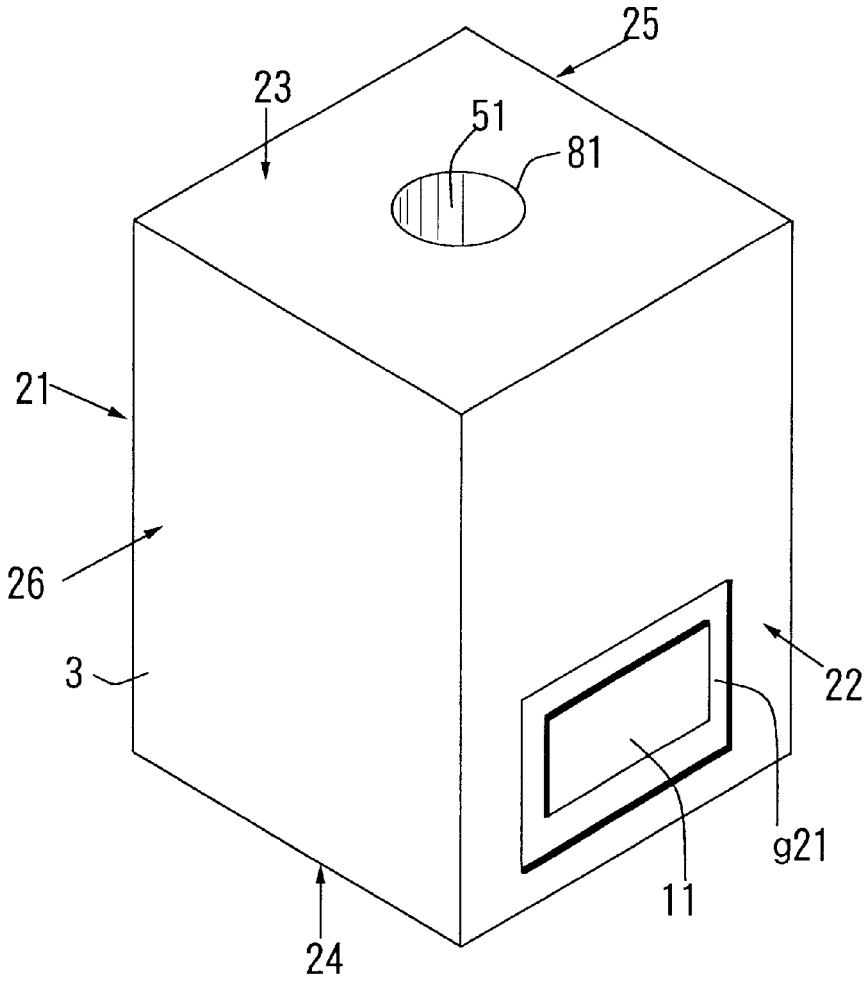
FIG. 2 is a perspective view of the dielectric resonator shown in FIG. 1 as seen from the rear side.
Figure 3:
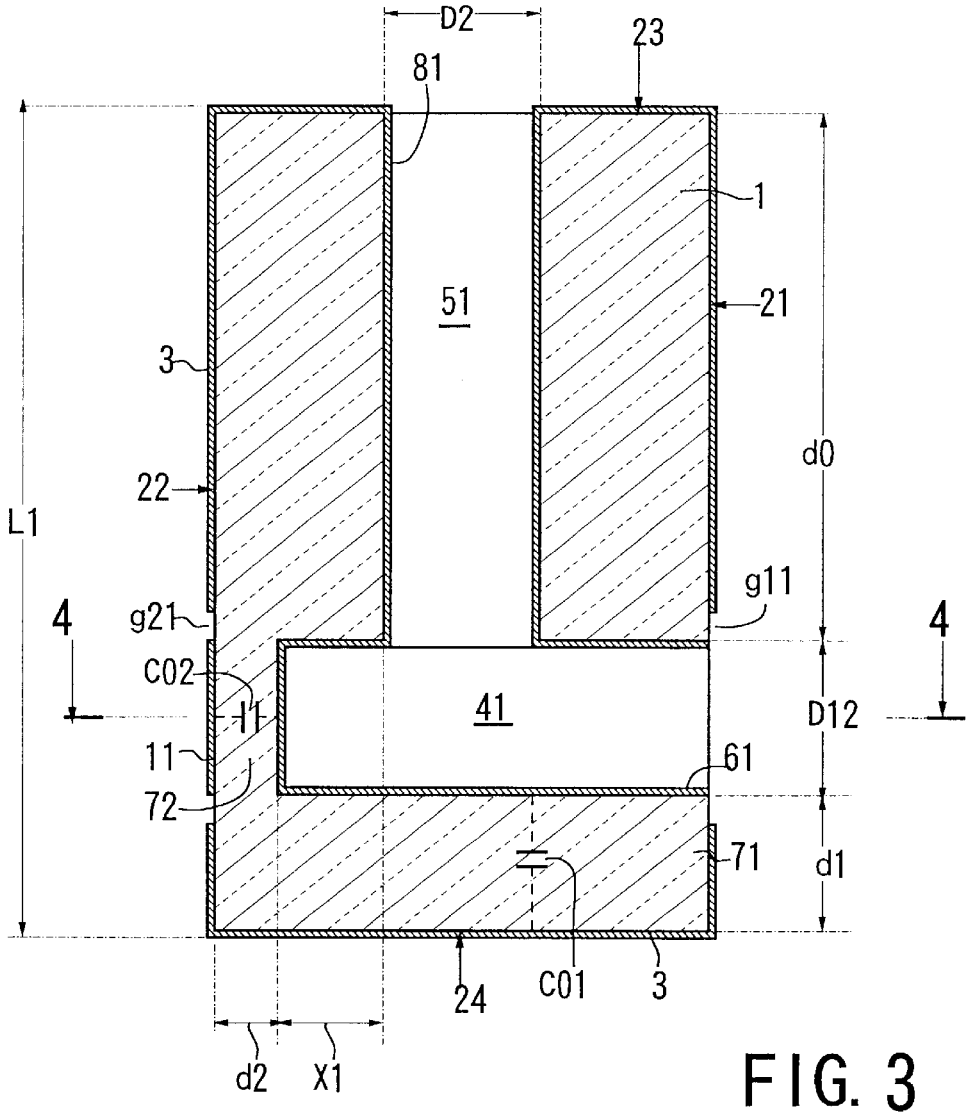
FIG. 3 is a cross-sectional view along the line 3—3 in FIG. 1.
Figure 4:
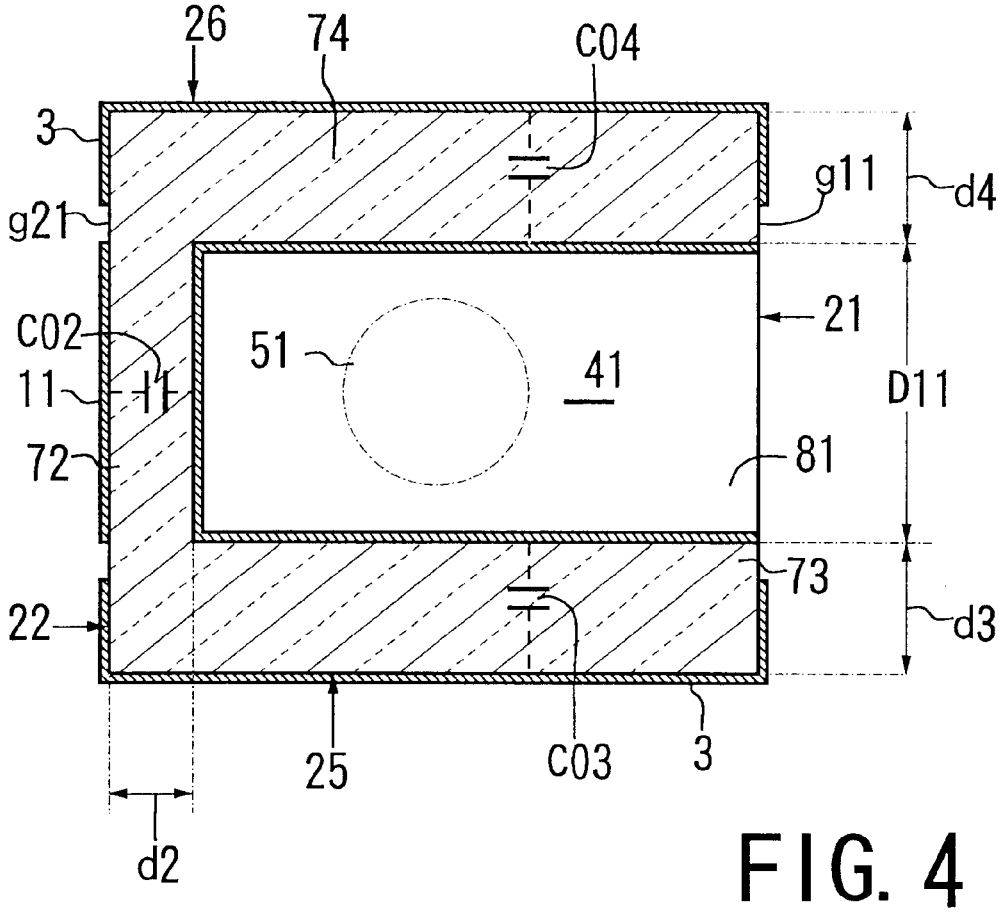
FIG. 4 is a cross-sectional view along the line 4—4 in FIG. 3.

FIG. 1 is a perspective view of a dielectric resonator relating to the present invention, FIG. 2 is a perspective view of the dielectric resonator shown in FIG. 1 viewed from the rear side, FIG. 3 is a cross-sectional view along the line 3—3 in FIG. 1, and FIG. 4 is a cross-sectional view along the line 4—4 in FIG. 3. The dielectric resonator shown in the drawings includes a dielectric substarate 1 and a single resonator unit Q1. A conventional dielectric ceramic is used to fashion the dielectric substarate 1 into a body whose external shape is approximately a hexahedron with surfaces 21 to 26, and the larger areas of the external surfaces 22 to 26 except the first surface 21 (the open surface) are covered by an external conductor film 3. The external conductor film 3 is commonly formed by a process such as enameling or plating with copper, silver, or the like as a main component.

The resonator unit Q1 comprises a first hole 41 and a second hole 51. The first hole 41 is provided to the dielectric substarate 1, has one end open to the first surface 21, and extends from the first surface 21 toward the external surface 22 opposite thereto. The interior of the first hole 41 is provided with a first internal conductor 61. The first internal conductor 61 is formed as an electrode film from the same material and by the same means as the external conductor film 3. Alternatively, the first internal conductor 61 may be formed such that it fills a part or all of the first hole 41. The first internal conductor 61 is separated from the external conductor film 3 by a gap g11 on the first surface 21.

The second hole 51 is also provided to the dielectric substarate 1. The second hole 51 has one end open to the external surface 23, and the second hole 51 extends from the external surface 23 toward the external surface 24 opposite thereto and connects with the first hole 41 in the interior of the dielectric substarate 1.

The interior of the second hole 51 is provided with a second internal conductor 81. The end of the second internal conductor 81 that is open to the external surface 23 is connected to the external conductor film 3, and the other end is connected to the first internal conductor 61. The second internal conductor 81 is formed from the same material and by the same means as the first internal conductor 61. The second internal conductor 81 may be formed such that it fills a part or all of the second hole 51.

In the illustrated embodiment, the second hole 51 is substantially circular with an inside diameter D2, and, as seen from FIG. 1, the first hole 41 has an approximately rectangular shape in which a crosswise inside diameter D11 is larger than a lengthwise inside diameter D12. The crosswise inside diameter D11 is larger than the inside diameter D2 of the second hole 51. Consequently, the other end of the second hole 51 is designed such that it connects with the second hole 51 within the breadth of the first hole 41. The first hole 41 preferably has rounded corners.

Another feature of the embodiment is that the first hole 41 protrudes lengthwise a distance X1 past the connecting area with the second hole 51 (see FIG. 3).

The distance d0 between the first hole 41 and the external surface 23 in which the second hole 51 opens is greater than the distance d1 between the first hole 41 and the external surface 24 opposing the second hole 51 (see FIG. 3). Specifically, d0>d1.

Dielectric layers 71 to 74 with thicknesses d1 to d4 are present between the first internal conductor 61 provided to the inner surface of the first hole 41 and the external conductor film 3 provided to the external surfaces 22 and 24 to 26 (see FIGS. 3 and 4). Furthermore, a terminal 11 is provided on the external surface 22, being separated from the external conductor film 3 by a gap g21 on the external surface 22. The terminal 11 is coupled with the first internal conductor 61 by an electrostatic capacitance C02 via the dielectric layer 72.

As previously described, the resonator unit Q1 includes the first hole 41 and the second hole 51. The first hole 41 has one end open to the first surface 21 and extends from the first surface 21 toward the external surface 22 opposite thereto. The second hole 51 has one end open to the external surface 23 and extends from the external surface 23 toward the external surface 24 opposite thereto, while the other end of the second hole 51 connects with the first hole 41 in the interior of the dielectric substarate 1. Specifically, a new hole configuration is obtained in which the second hole 51 intersects with the first hole 41 having one end placed in the first surface 21.

In this new hole configuration, the first internal conductor 61 provided to the first hole 41 and the second internal conductor 81 provided to the second hole 51 are connected to each other, so the first hole 41 and the second hole 51 constitute one electric circuit. The first internal conductor 61 of the first hole 41 faces the external conductor film 3 provided on the external surfaces 22 and 24 to 26 via the dielectric layers 71 to 74 composed of the dielectric substarate 1. Consequently, a capacitive coupling is formed between the first internal conductor 61 and the external conductor film 3.

It is also possible to provide a plurality of first holes 41. In this case, each of the plurality of first holes opens in a different external surface, and is provided with a first internal conductor being connected to the second internal conductor 81 within the dielectric substarate 1. For example, in the embodiment shown in FIGS. 1 to 4, one or a plurality of first holes is provided so as to extend in the direction intersecting with the second hole 51 and is made to intersect with the end of the second hole 51, and the first internal conductors are made to connect to the second internal conductor 81, as shown in FIGS. 1 to 4. Because the embodiment in FIGS. 1 to 4 employ a six-sided dielectric substarate 1, the above-described supplemental configuration for the first hole can be achieved using the external surfaces 21, 22, 24, 25, and 26.

As previously described, since the first internal conductor 61 of the first hole 41 faces the external conductor film 3 via the dielectric layers 71, 73, and 74 composed of the dielectric substarate 1, large electrostatic capacitances C01, C03, and C04 are formed between the first internal conductor 61 and the external conductor film 3 (see FIGS. 3 and 4). Therefore, the dielectric device relating to the present invention resonates at a frequency that is less than the electric length in relation to the length L1 of the dielectric substarate 1 as seen from the axial direction of the second hole 51. In other words, miniaturization and height reduction can be achieved by shortening the length L1 of the dielectric substarate 1 in order to obtain the desired resonant frequency.

In the case of an embodiment in which the distance d0 between the first hole 41 and the external surface 23 in which the second hole 51 opens is greater than the distance (thickness) d1 between the first hole 41 and the external surface 24 opposing the second hole 51, and in which the relationship d0>d1 is satisfied, it is possible to obtain an electrostatic capacitance C01 according to the measurement of the distance (thickness) d1.

Next, a specific example will be given to describe miniaturization and height reduction of the dielectric resonator shown in the embodiment. In the configuration shown in FIGS. 1 to 4, the dielectric substarate 1 is given an approximately rectangular parallellepiped shape using dielectric material with a relative dielectric constant $\epsilon r=92$. The measurements of the dielectric substarate 1 are set such that the area seen in the surface 23 is (2 mm×2 mm) and the length L1 is 2.5 mm. The diameter D2 of the second hole 51 is 0.5 mm, and the diameter D11 of the first hole 41 is 1 mm.

The resonant frequency when the resonator is loosely coupled was measured at 2.02 GHz. Because in conventional practice the length L1 needs to be about 3.5 to 4 mm in a quarter-wavelength resonator with a resonant frequency of 2.02 GHz, a reduction of about 30% can be achieved with the present embodiment.

Figure 5:
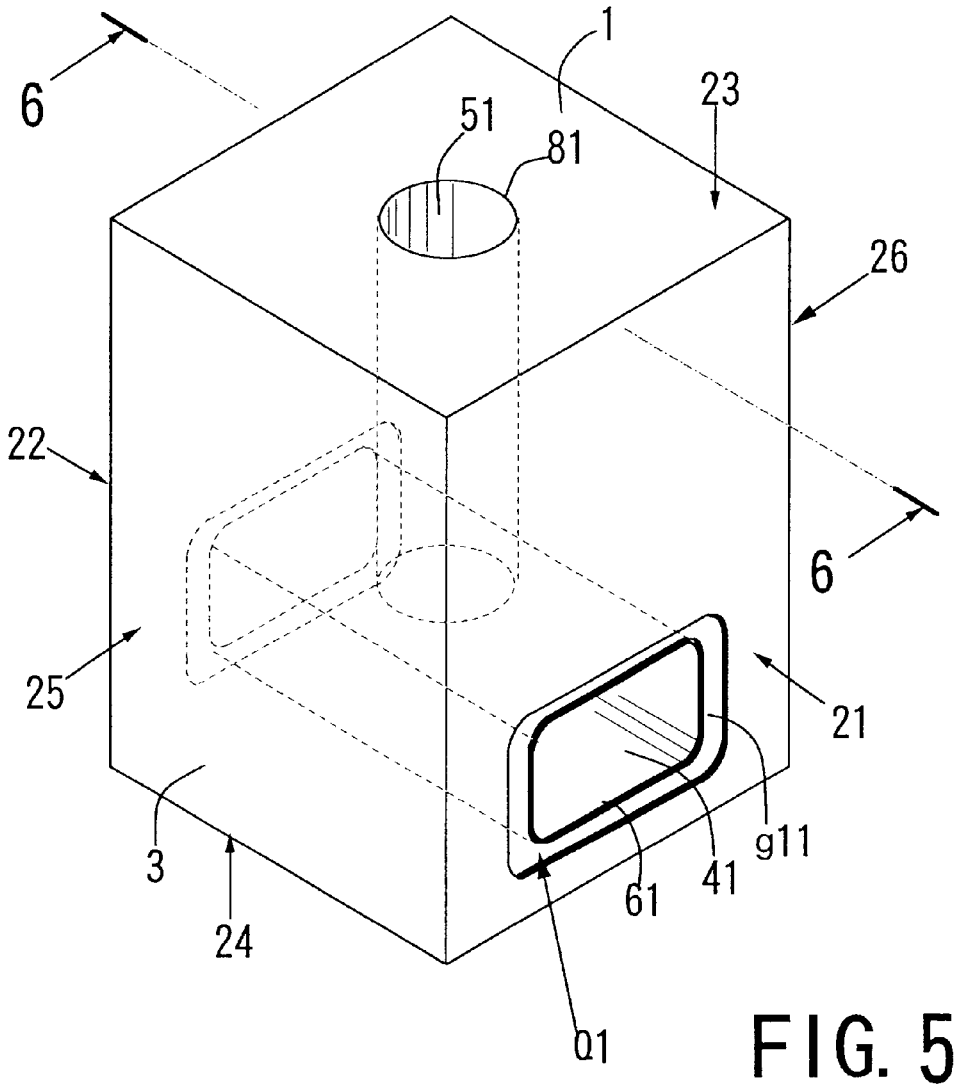
FIG. 5 is a perspective view depicting another embodiment of a dielectric resonator relating to the present invention.
Figure 6:
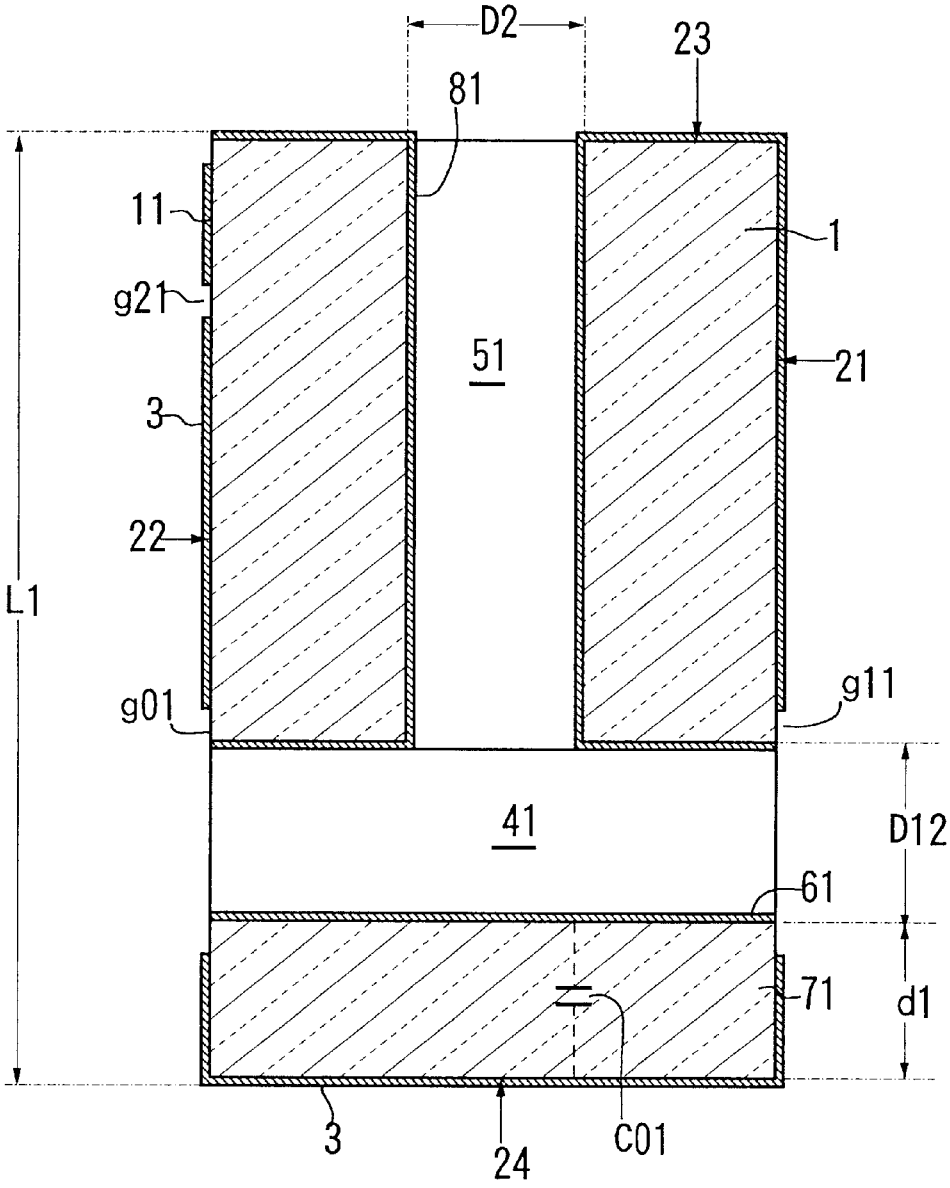
FIG. 6 is an expanded cross-sectional view along the line 6—6 in FIG. 5.

FIG. 5 is a perspective view depicting another embodiment of a dielectric resonator, and FIG. 6 is an expanded cross-sectional view along the line 6—6 in FIG. 5. In these diagrams, identical reference symbols are assigned to structural components identical to those appearing in FIGS. 1 to 4, and redundant explanations are avoided if possible. In the embodiment shown in FIGS. 5 and 6, one end of the first hole 41 opens in the first surface 21, while the other end opens in the external surface 22 opposing the first surface 21. The first internal conductor 61 provided to the interior of the first hole 41 is separated from the external conductor film 3 by the gap g11 on the first surface 21, and is separated from the external conductor film 3 by a gap g01 on the external surface 22.

In the case of this embodiment, because the overlapping areas increase between the first internal conductor 61 and the external conductor film 3 provided to the external surfaces 24 to 26, increased electrostatic capacitances C01, C03, and C04 (see FIG. 4) can be acquired.

Another feature of the embodiment shown in FIGS. 5 and 6 is that the terminal 11 is provided to the external surface 22 of the dielectric substarate 1 and is capacitively coupled with the second internal conductor 81 via a dielectric layer. The terminal 11 is separated from the external conductor film 3 by the gap g21.

Miniaturization and height reduction are also possible with the dielectric resonators shown in the embodiment depicted in FIGS. 5 and 6.

Figure 7:
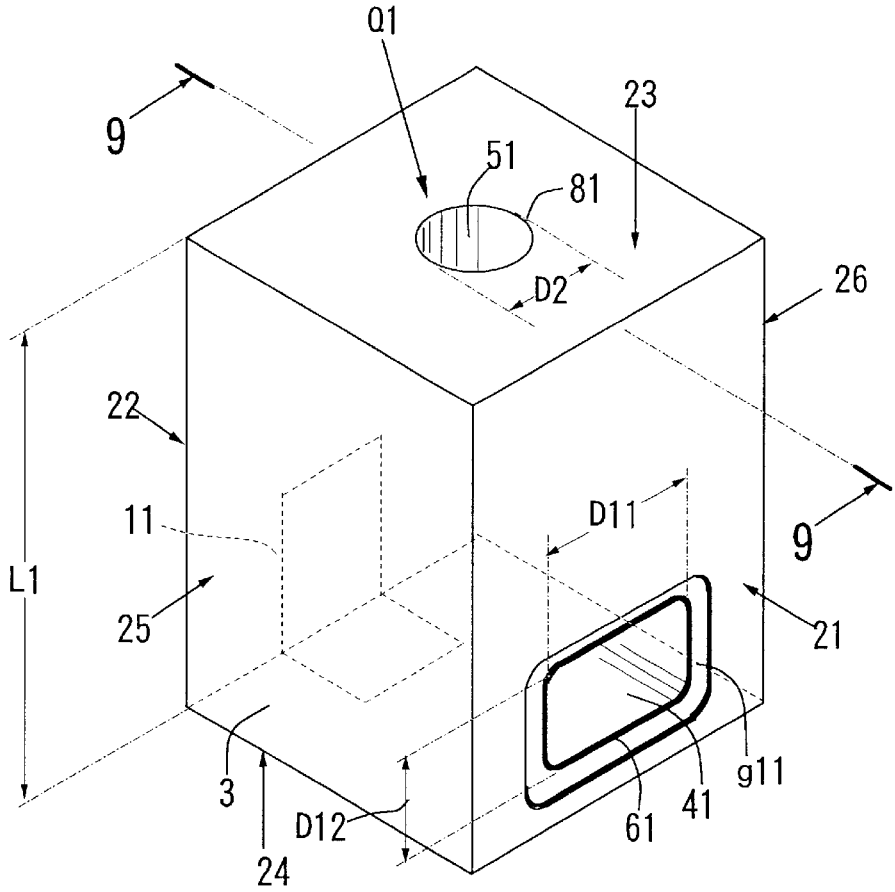
FIG. 7 is a perspective view depicting yet another embodiment of a dielectric resonator relating to the present invention.
Figure 8:
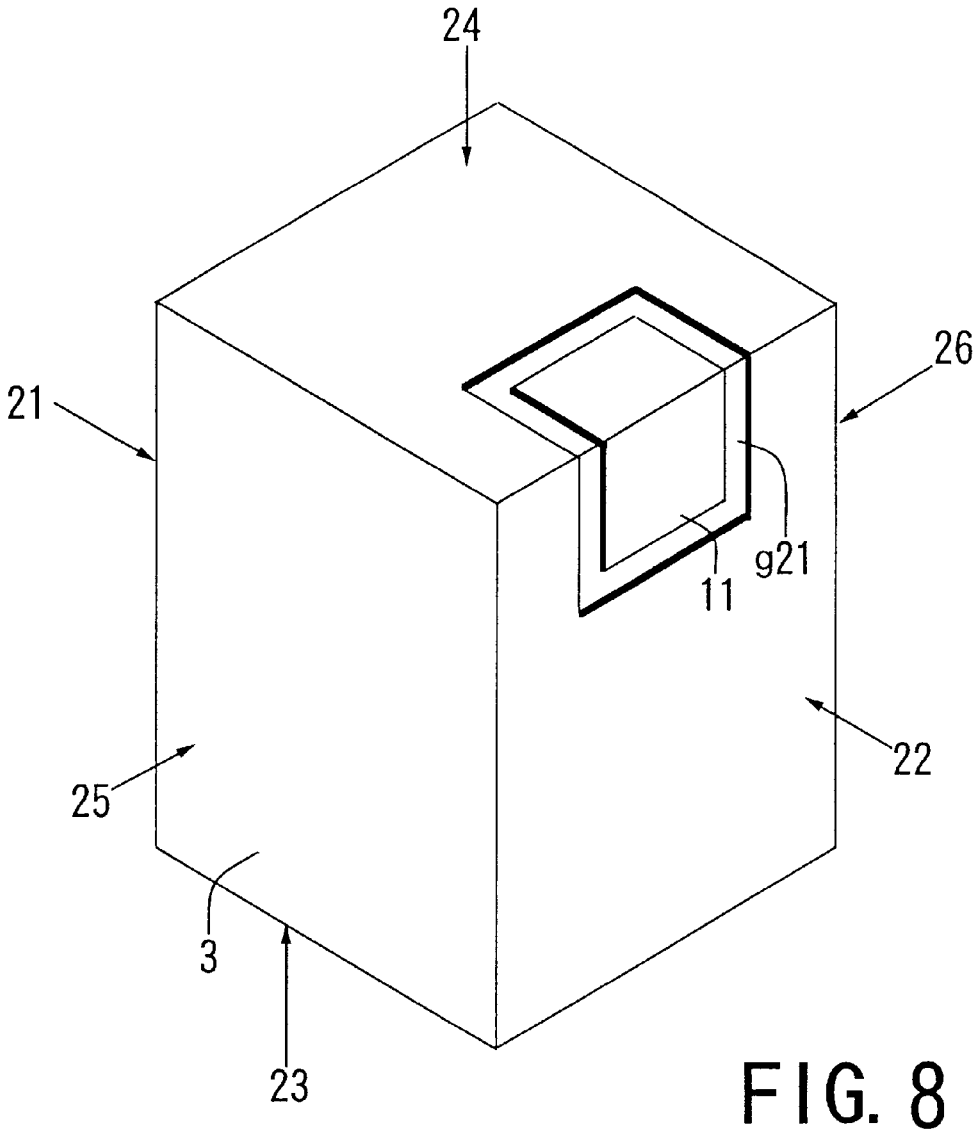
FIG. 8 is a perspective view of the dielectric filter shown in FIG. 7 as seen from the bottom side.
Figure 9:
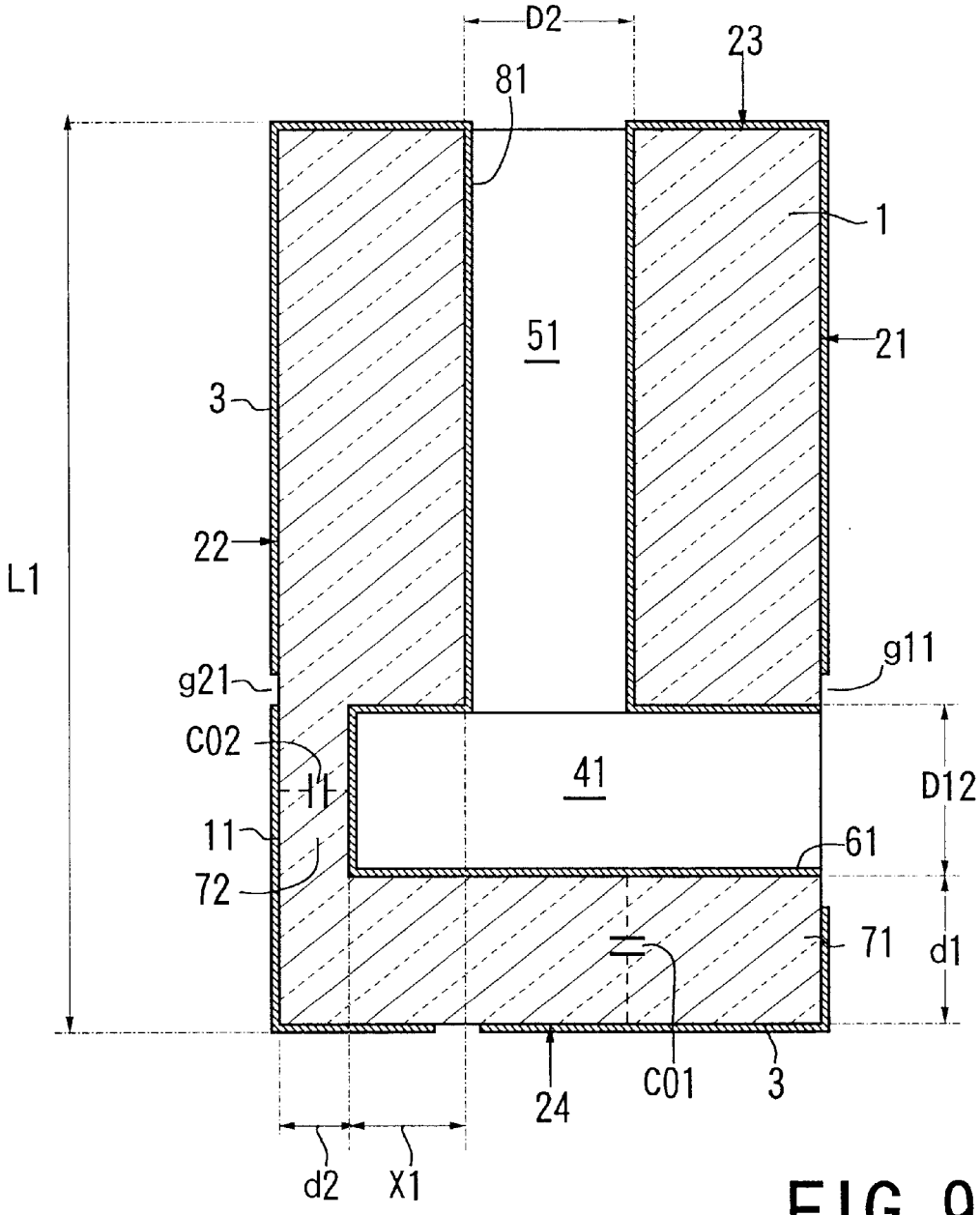
FIG. 9 is a cross-sectional view along the line 9—9 in FIG. 7.

FIG. 7 is a perspective view depicting an embodiment of yet another dielectric resonator relating to the present invention, FIG. 8 is a perspective view of the dielectric resonator shown in FIG. 7 as seen from the underside, and FIG. 9 is a cross-sectional view along the line 9—9 in FIG. 7. In this embodiment, the terminal 11 is formed extending over the external surface 22 and the underside external surface 24. Miniaturization and height reduction of the dielectric resonators are also possible in this embodiment.

Figure 10:
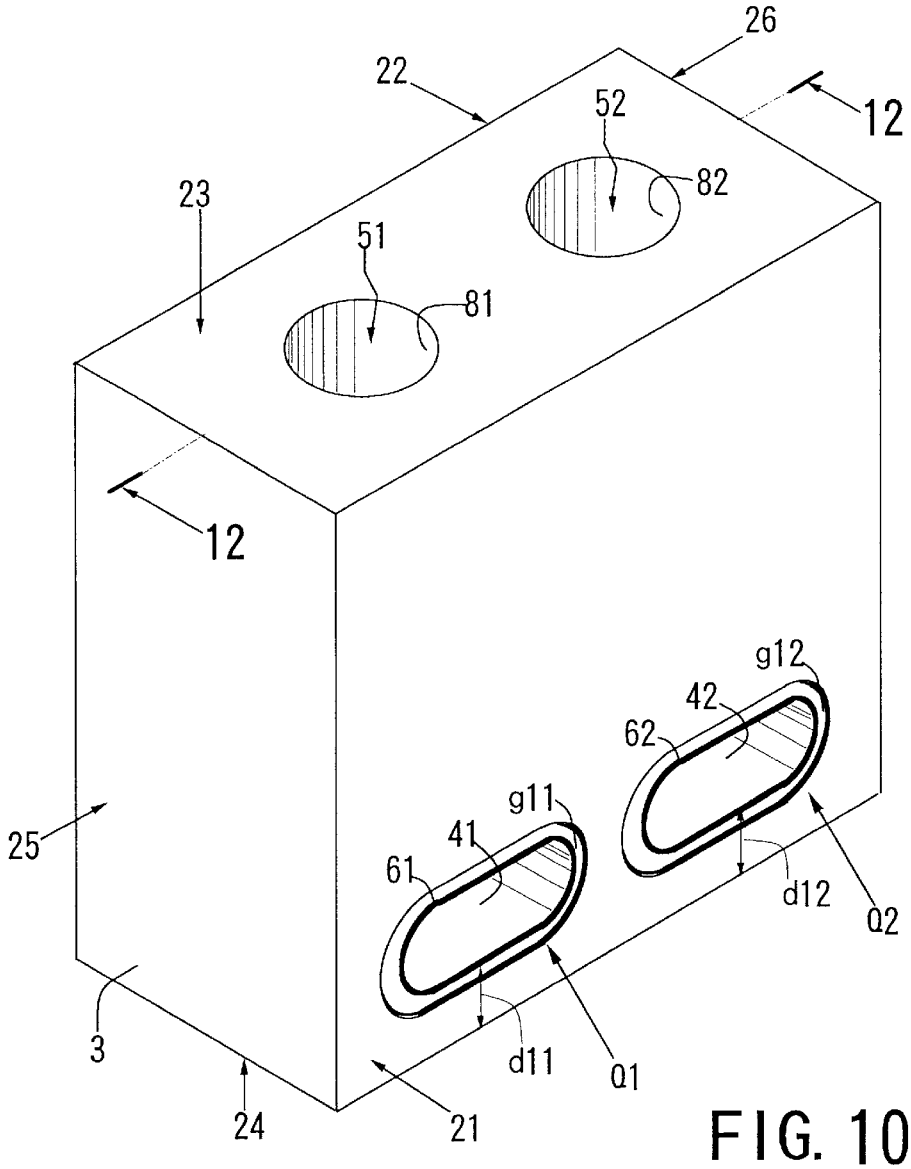
FIG. 10 is a perspective view of a dielectric filter relating to the present invention.
Figure 11:
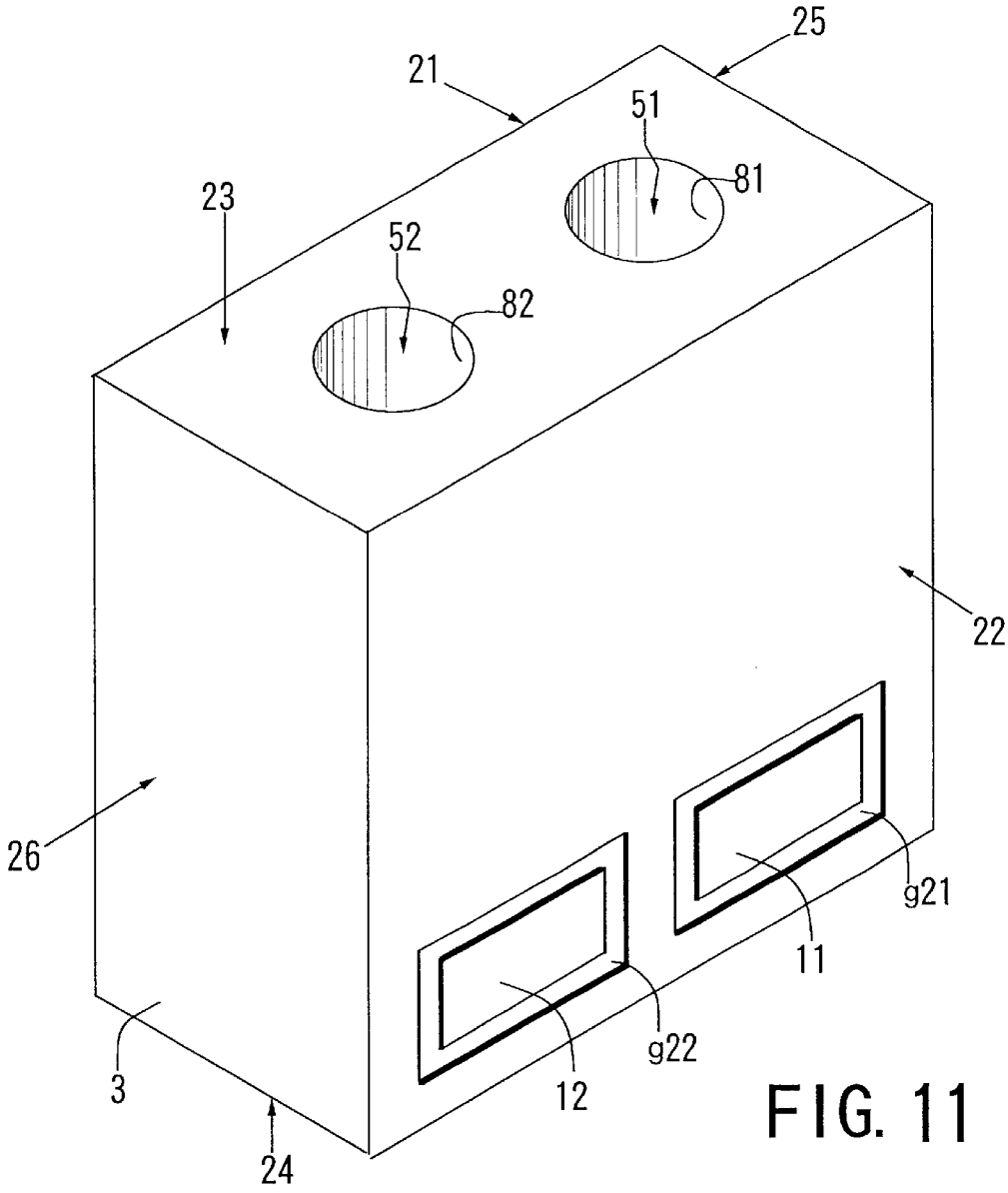
FIG. 11 is a perspective view of the dielectric filter shown in FIG. 10 as seen from the rear side.
Figure 12:
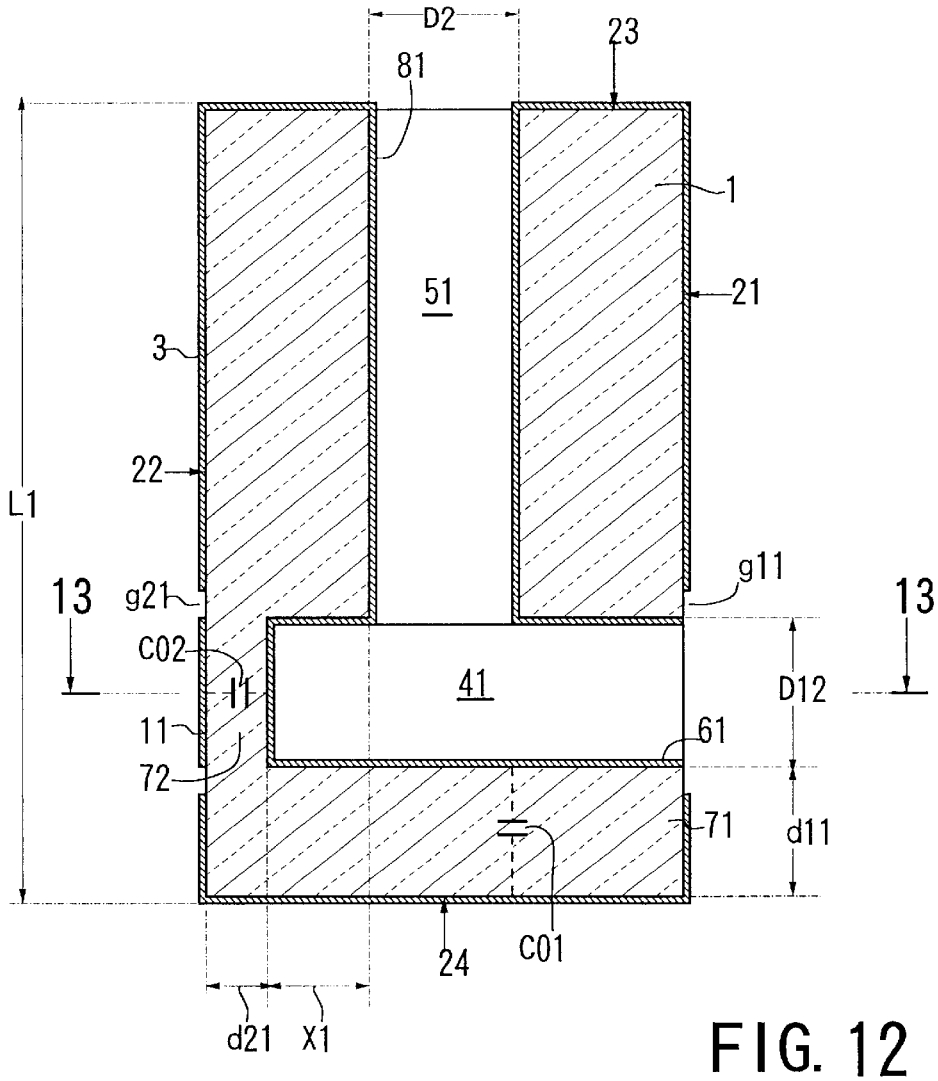
FIG. 12 is a cross-sectional view along the line 12—12 in FIG. 10.
Figure 13:
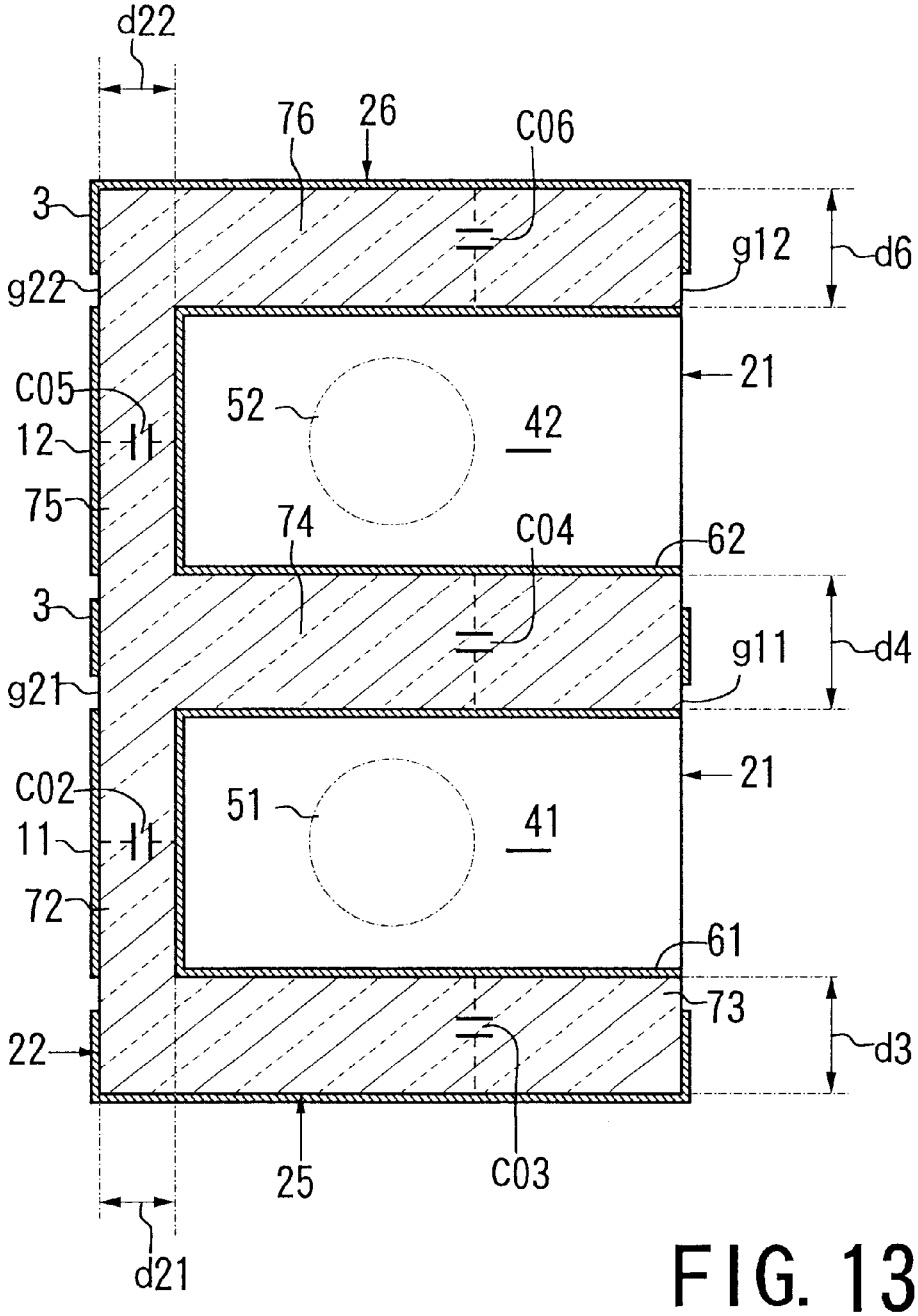
FIG. 13 is a cross-sectional view along the line 13—13 in FIG. 12.

FIG. 10 is a perspective view depicting an embodiment of a dielectric filter relating to the present invention, FIG. 11 is a perspective view of the dielectric filter shown in FIG. 10 as seen from the rear side, FIG. 12 is a cross-sectional view along the line 12—12 in FIG. 10, and FIG. 13 is a cross-sectional view along the line 13—13 in FIG. 12. These diagrams depict an example of a dielectric filter having two resonator units Q1 and Q2. The resonator units Q1 and Q2 share the dielectric substarate 1 and are integrated via the dielectric substarate 1. The resonator unit Q1 includes the first hole 41 and the second hole 51. The first hole 41 and second hole 51 can employ any of the configurations heretofore illustrated and described. When the configuration shown in FIGS. 1 to 4 is employed, the first hole 41 has one end open in the first surface 21 and extends from the first surface 21 toward the external surface 22 thereto. The interior of the first hole 41 is provided with the first internal conductor 61. The first internal conductor 61 is separated from the external conductor film 3 on the first surface 21 by the gap g11.

One end of second hole 51 opens in the external surface 23 that is not opposing the first surface 21, while the other end connects with the other end of the first hole 41 in the interior of the dielectric substarate 1. One end of the second internal conductor 81 of the second hole 51, which opens in the external surface 23, is connected to the external conductor film 3, while the other end is connected to the first internal conductor 61 in the interior of the dielectric substarate 1.

The resonator unit Q2 has a configuration substantially identical to that of the resonator unit Q1, and comprises a first hole 42 and a second hole 52. The first hole 42 and second hole 52 can have any of the configurations illustrated and described in FIGS. 1 to 9. When the configuration shown in FIGS. 1 to 4 is employed, the first hole 42 has one end open in the first surface 21 and extends from the first surface 21 toward the external surface 22. The interior of the first hole 42 is provided with a first internal conductor 62. The first internal conductor 62 is separated from the external conductor film 3 on the first surface 21 by a gap g12.

One end of the second hole 52 opens in the external surface 23 adjacent to the first surface 21, while the other end connects with the other end of the first hole 42 in the interior of the dielectric substarate 1. One end of a second internal conductor 82 of the second hole 52, which opens in the external surface 23, is connected to the external conductor film 3, while the other end is connected to the first internal conductor 62. More-specific aspects of the resonator units Q1 and Q2 are as described with reference to FIGS. 1 to 9, and redundant explanations are therefore omitted herein.

Furthermore, in the embodiment, the external surface 22 of the dielectric substarate 1 is provided with a first terminal 11 and a second terminal 12 as input/output terminals (see FIGS. 11 to 13). The first terminal 11 is provided to a position opposing the first hole 41 via the dielectric layer 72 of thickness d21 and is electrically insulated from the external conductor film 3 by the insulating gap g21.

The second terminal 12 is provided to a position opposing the first hole 42 via the dielectric layer 75 of thickness d22 and is electrically insulated from the external conductor film 3 by an insulating gap g22.

Between the first and second terminals 11 and 12 and the internal conductors 61 and 62 of the first holes 41 and 42 is created a coupling capacitance that is determined by the thickness between the dielectric layers and by the dielectric constant and surface areas thereof. The first and second terminals 11 and 12 are not required to overlap the internal conductors 61 and 62 of the first holes 41 and 42. They may be provided at positions where they partially face each other or at positions where they do not face each other at all. The insulating gaps g21 and g22 may also be connected as one gap.

Whether the coupling between the resonator unit Q1 and the resonator unit Q2 is a capacitive coupling or an inductive coupling depends on the relative relationship between the capacitance C04 and the capacitances C01, C03 and C06; and the capacitance C04 is formed between the internal conductors 61 and 62 of the first holes 41 and 42 that constitute the resonator units Q1 and Q2, and the capacitances C01, C03, and C06 are formed between the external conductor film 3 and the first internal conductors 61 and 62 of the first holes 41 and 42. When the former is stronger, the coupling between Q1 and Q2 is predominantly capacitive, and when the latter is stronger, the coupling is predominantly inductive.

Since the resonator unit Q2 is of the same configuration as the resonator unit Q1 in the dielectric filter shown in FIGS. 10 to 13, the description of the operation and advantages of the resonator unit Q1 can also be applied to the resonator unit Q2. When the entire dielectric filter is being operated, the coupling between the resonator unit Q1 and the resonator unit Q2 should be taken into account.

Figure 14:
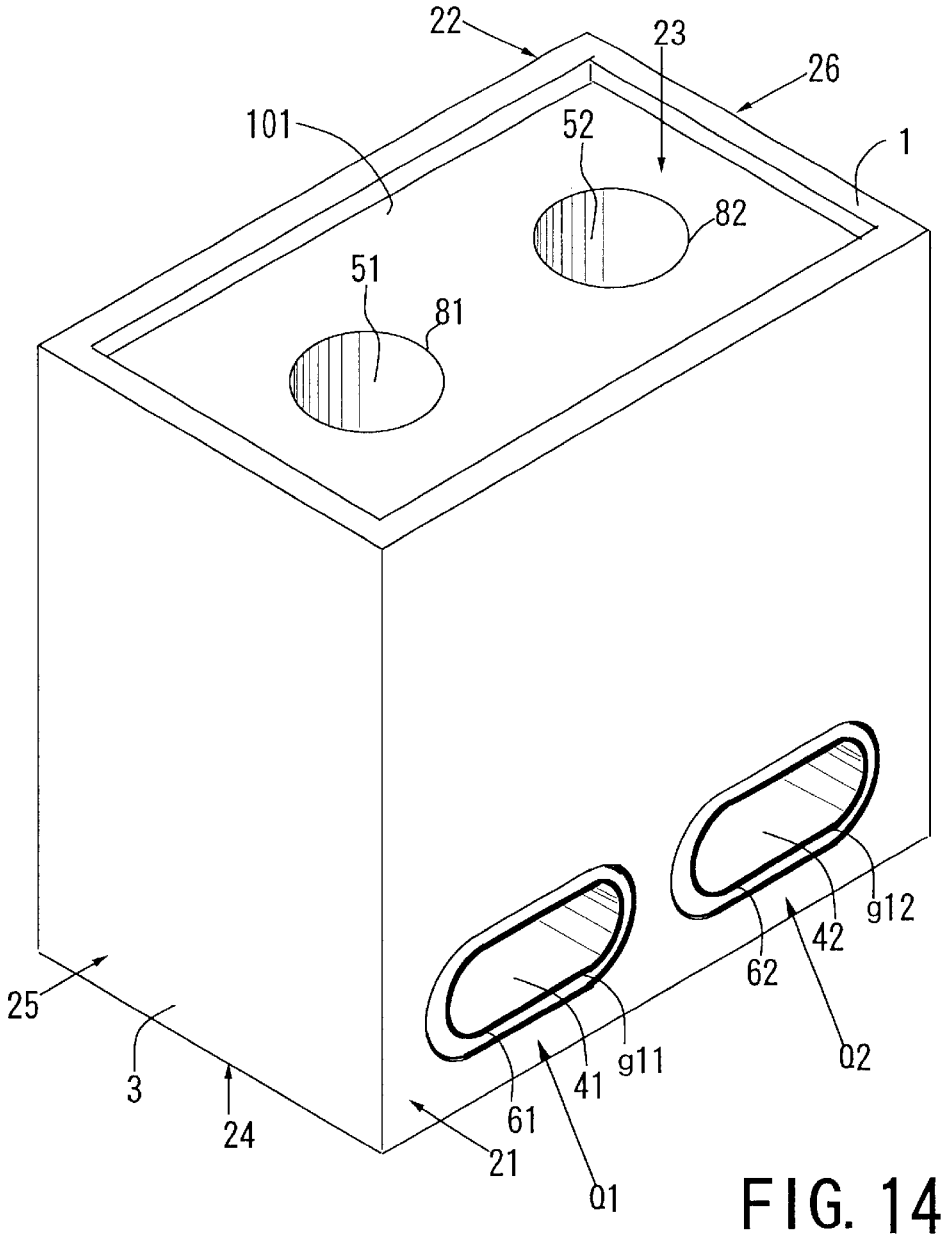
FIG. 14 is a perspective view depicting another embodiment of a dielectric filter relating to the present invention.

FIG. 14 is a perspective view depicting another embodiment of a dielectric filter relating to the present invention. A feature of the embodiment shown in FIG. 14 is that it has a recess 101 in the external surface 23 of the dielectric substarate 1. The recess 101 comprises the second holes 51 and 52 of the resonator units Q1, Q2 inside thereof.

According to the embodiment of FIG. 14, coupling properties between the resonator units Q1, Q2 and resonant frequencies thereof can be adjusted by selecting the dimensions of the recess 101.

Figure 15:
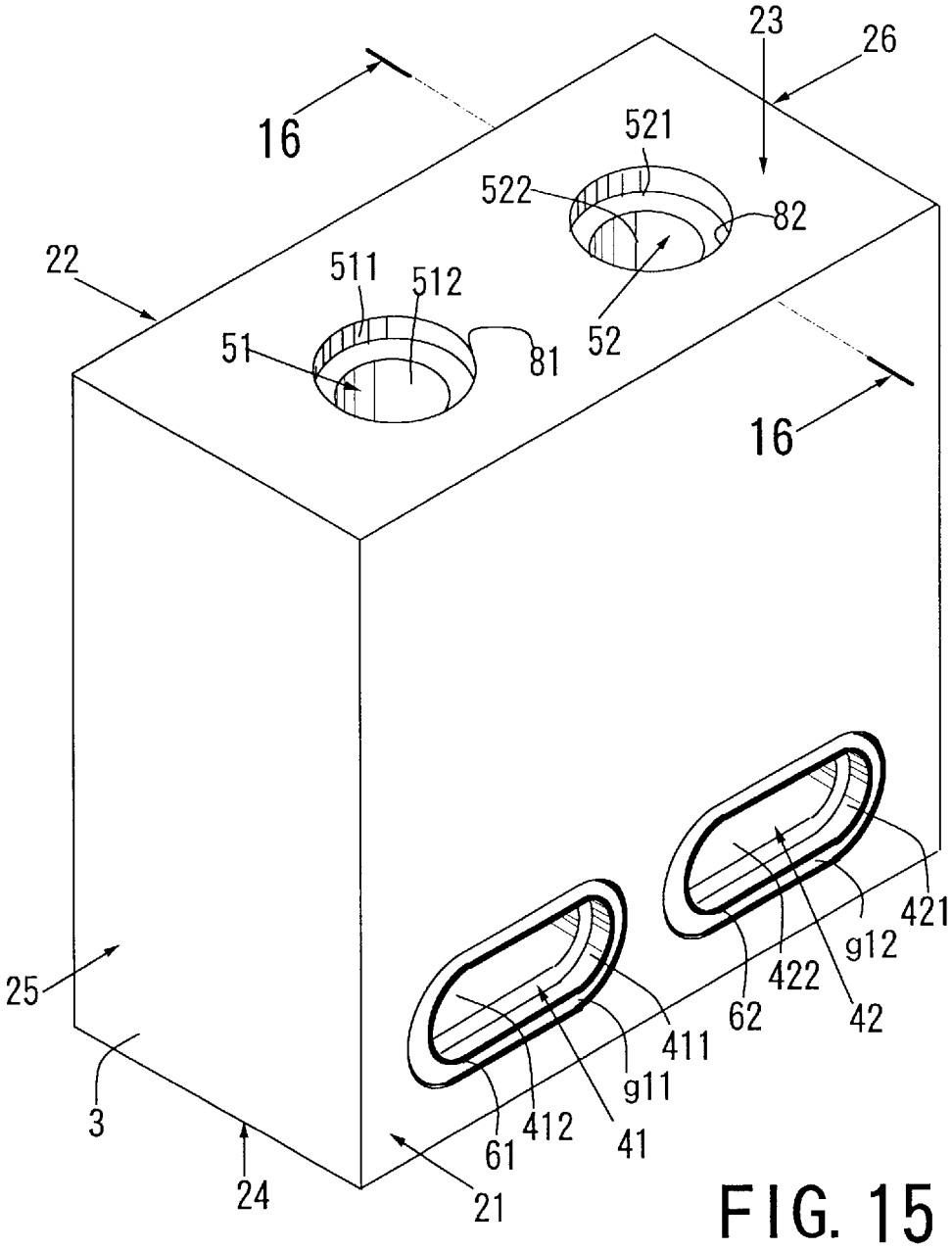
FIG. 15 is a perspective view depicting yet another embodiment of a dielectric filter relating to the present invention.
Figure 16:
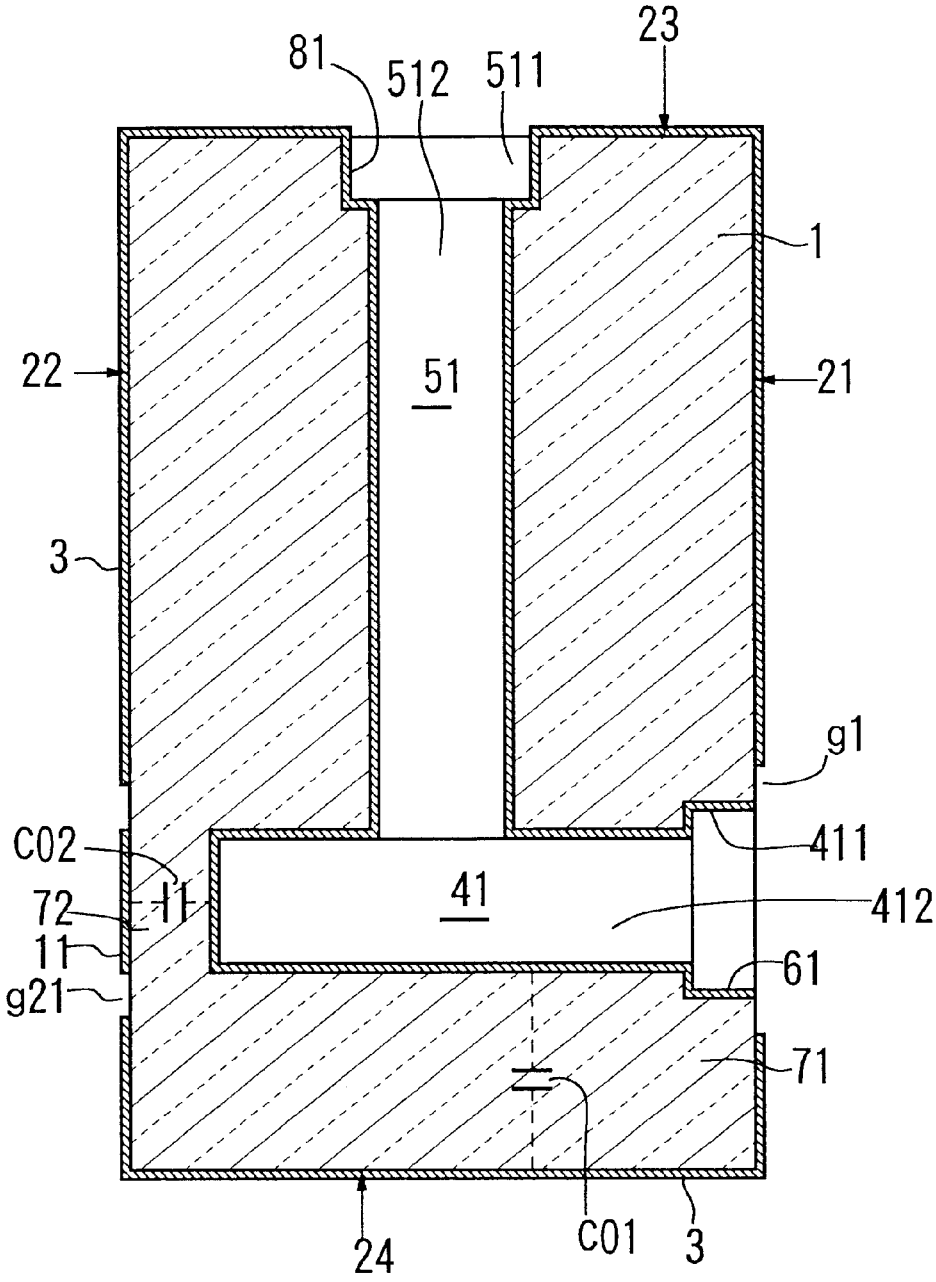
FIG. 16 is a cross-sectional view along the line 16—16 in FIG. 15.

FIG. 15 is a perspective view depicting yet another embodiment of a dielectric filter relating to the present invention, and FIG. 16 is a cross-sectional view along the line 16—16 in FIG. 15. In the illustrated embodiment, the first hole 41 comprises a large opening 411 and a small opening 412. The large opening 411 opens in the first surface 21, and the small opening 412 continues past the back of the large opening 411. The first hole 42 also comprises a large opening 421 and a small opening 422, and the large opening 421 opens in the first surface 21, while the small opening 422 continues past the back of the large opening 421.

In the embodiment in FIGS. 15 and 16, the second holes 51 and 52 comprise large openings 511 and 521 and small openings 512 and 522. The large openings 511 and 521 open in the external surface 23, and the small openings 512 and 522 continue past the back of the large openings 511 and 521.

In the case of the embodiment shown in FIGS. 15 and 16, coupling properties between the resonator unit Q1 and the resonator unit Q2 and resonant frequencies thereof can be adjusted by selecting the diameters of the large openings (411, 421), and (511, 521).

Figure 17:
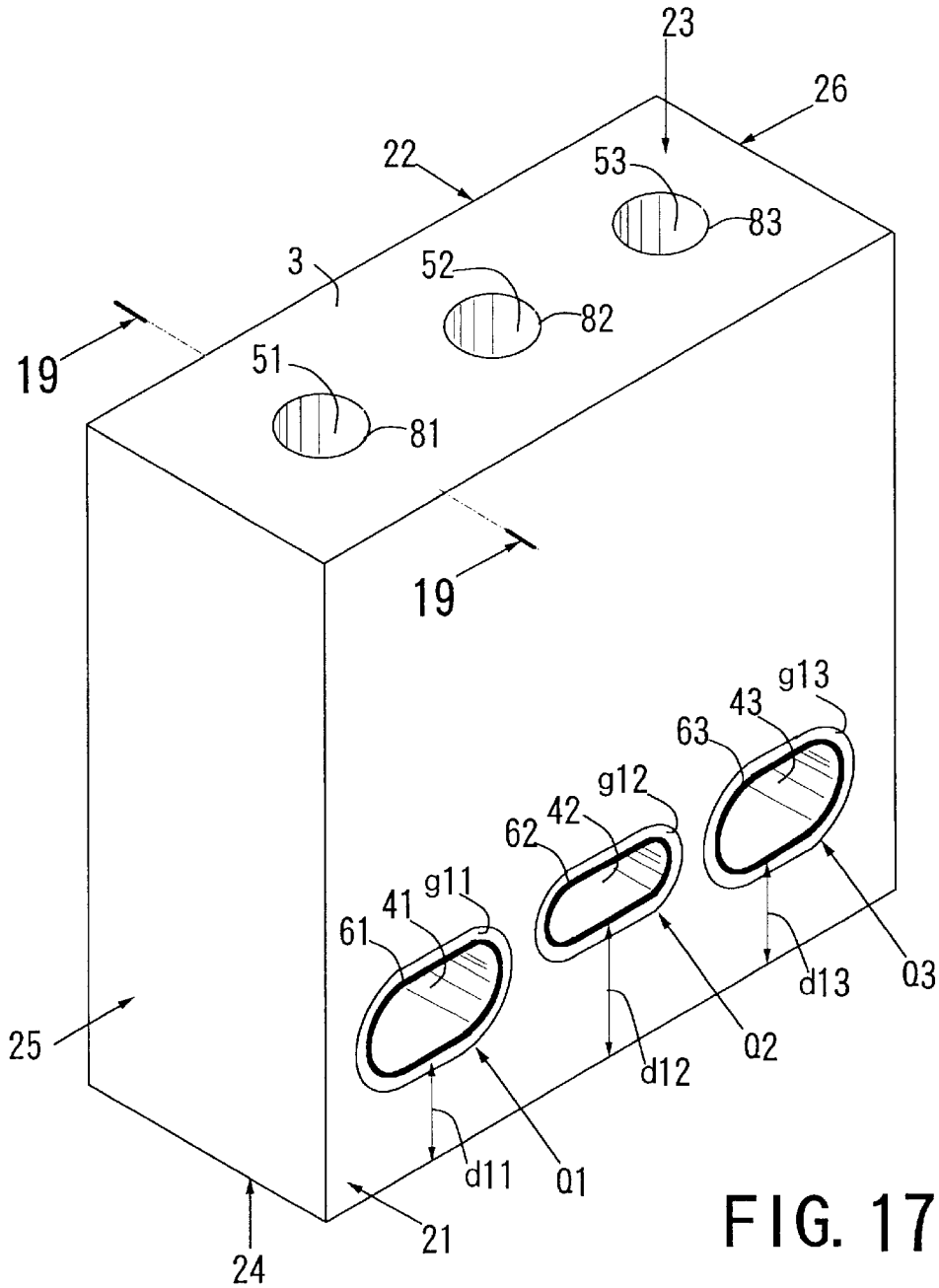
FIG. 17 is a perspective view depicting a dielectric filter having three resonator units.
Figure 18:
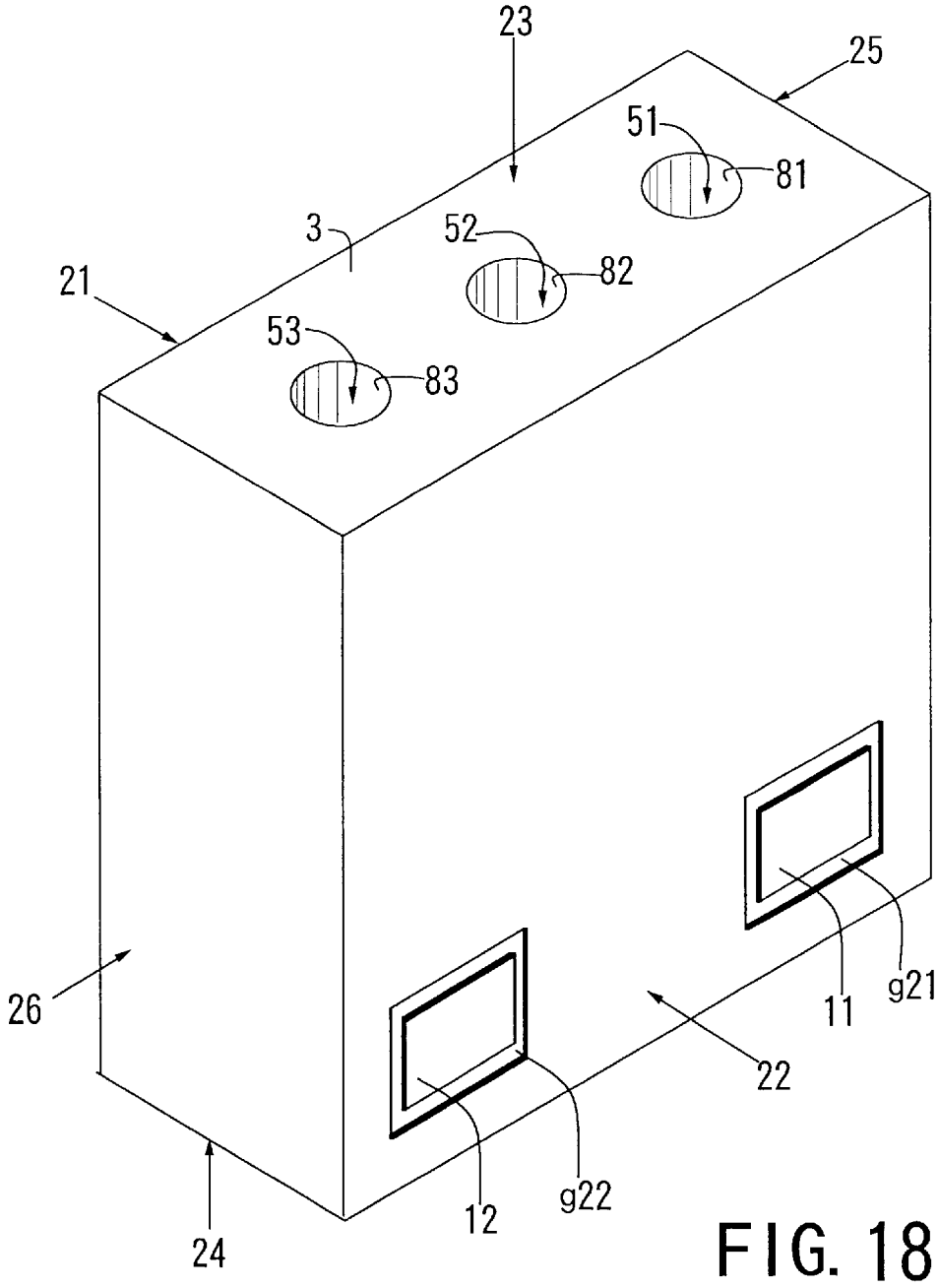
FIG. 18 is a perspective view of the dielectric filter shown in FIG. 17 as seen from the rear side.
Figure 19:
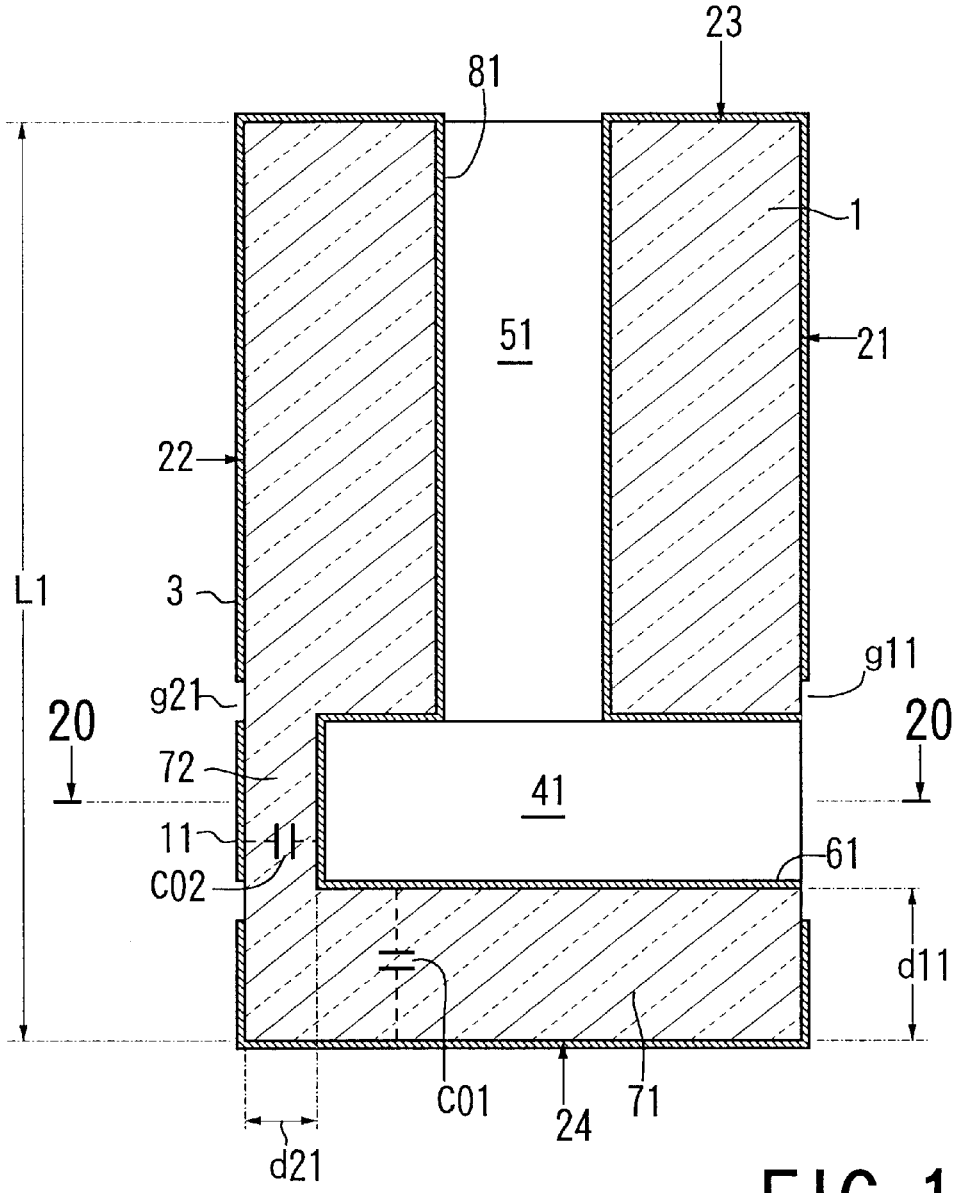
FIG. 19 is a cross-sectional view along the line 19—19 in FIG. 17.
Figure 20:
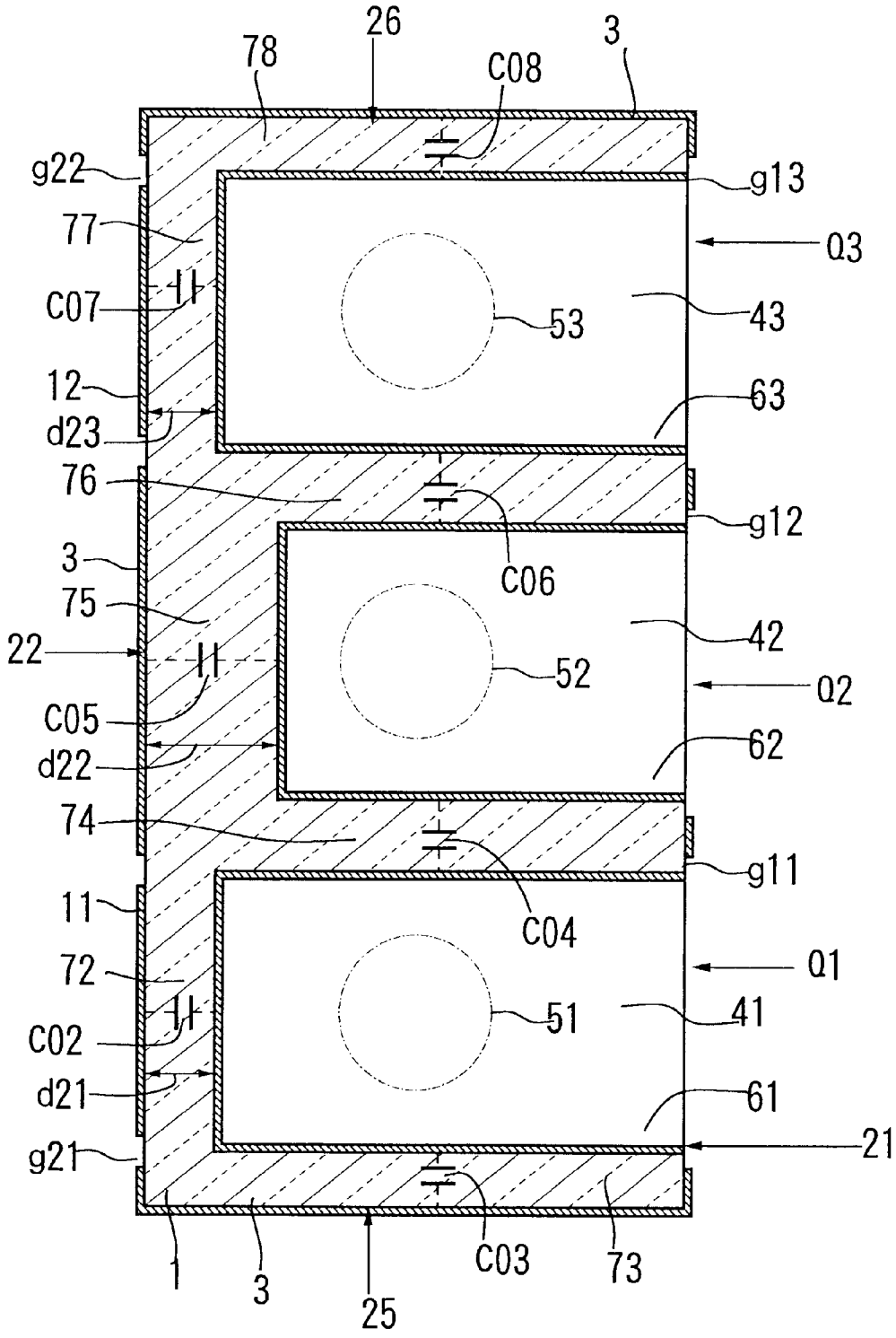
FIG. 20 is a cross-sectional view along the line 20—20 in FIG. 19.

FIG. 17 is a perspective view depicting a dielectric filter having three resonator units Q1 Q2, and Q3, FIG. 18 is a perspective view of the dielectric filter shown in FIG. 17 as seen from the rear side, FIG. 19 is a cross-sectional view along the line 19—19 in FIG. 17, and FIG. 20 is a cross-sectional view along the line 20—20 in FIG. 19.

The resonator units Q1, Q2, and Q3 all share the dielectric substarate 1 and are integrated by the dielectric substarate 1. In the dielectric substarate 1, the larger areas of the external surfaces except the first surface 21 are covered by the external conductor film 3.

The resonator unit Q1 comprises the first hole 41 and the second hole 51. The resonator unit Q2 comprises the first hole 42 and the second hole 52. The resonator unit Q3 comprises a first hole 43 and a second hole 53. The individual configurations and relative relationship of the first holes 41 to 43 and second holes 51 to 53 are as already described.

In the case of the illustrated embodiment, electrostatic capacitances C01, C02, C03, C05, C07, and C08 composed of dielectric layers 71, 72, 73, 75, 77, and 78 exist between the external conductor film 3 and the respective first internal conductors 61 to 63 provided to the interior of the first holes 41 to 43. An electrostatic capacitance C04 composed of the dielectric layer 74 exists between the resonator unit Q1 and the resonator unit Q2, and an electrostatic capacitance C06 composed of a dielectric layer 76 exists between the resonator unit Q2 and the resonator unit Q3 (see FIGS. 19 and 20). The value of the electrostatic capacitances C01 to C08 is set in accordance with the desired properties. Furthermore, it is acceptable for the thicknesses d11 to d13 (see FIG. 17) of the dielectric layer 71 in each of the resonator units Q1 to Q3 to be different, and also for the electrostatic capacitance C01 to be different in each of the resonator units Q1 to Q3.

In the embodiment, the depth of the first hole 42 in the resonator unit Q2 placed between the resonator units Q1 and Q3 is less than that of the resonator units Q1 and Q3, and the thickness d12 of the dielectric layer 71 in the resonator unit Q2 is greater than the thicknesses d11 and d13 of the dielectric layer 71 in the resonator units Q1 and Q3 (see FIG. 17). Consequently, the electrostatic capacitance C01 of the resonator unit Q2 is less than the electrostatic capacitance C01 of the resonator units Q1 and Q3.

The first terminal 11 is placed in a position corresponding to the first hole 41 in the external surface 22 and is electrically insulated from the external conductor film 3 by the insulating gap g21.

The second terminal 12 is placed in a position corresponding to the third hole 43 in the external surface 22 and is electrically insulated from the external conductor film 3 by the insulating gap g22.

According to the embodiment shown in FIGS. 17 to 20, in addition to achieving miniaturization and height reduction similar to the previous embodiments, the preferred properties of the frequency are improved due to the greater number of resonator units Q1 to Q3.

Next, specific examples are given to describe frequency properties of the dielectric filter shown in FIGS. 17 to 20. In the configuration shown in FIGS. 17 to 20, the dielectric substarate 1 is given an approximately rectangular parallelepiped shape using dielectric material with a relative dielectric constant $\epsilon r$=92. The shape of the dielectric substarate 1 is set such that the area seen in the surface 23 is (4.2 mm×2 mm) and the length L1 is 2.5 mm. The diameters D2 of the second holes 51 to 53 are 0.7 mm. Because the opposing surfaces of the adjacent first holes 41 to 43 are in close proximity, a large capacitance is generated in the area. Therefore, the adjacent resonator units Q1 to Q3 exhibit capacitive coupling.

Figure 21:
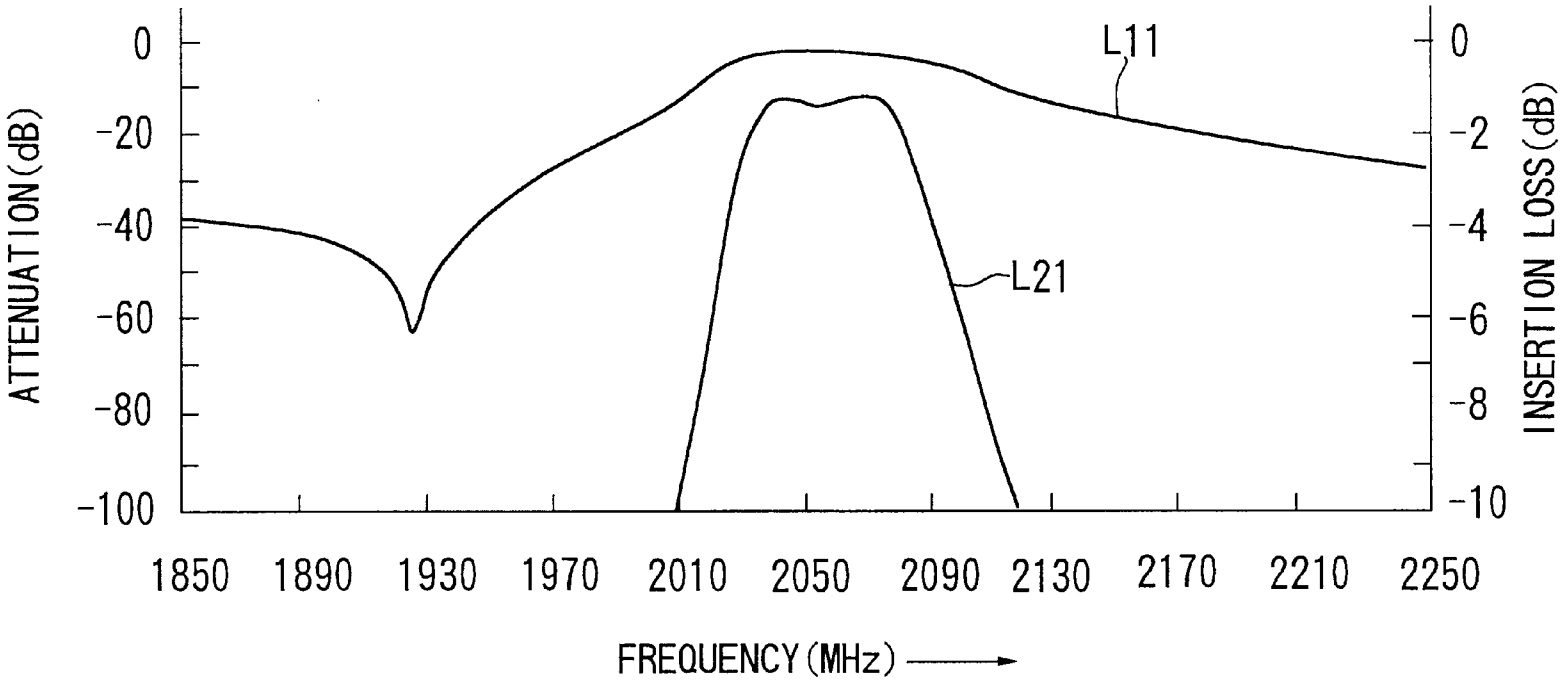
FIG. 21 is an diagram depicting the band-pass filter characteristic curve and insertion loss characteristic curve of a specific example relating to the embodiment in FIGS. 17–20.

FIG. 21 depicts the band-pass filter characteristic curve L11 and insertion loss characteristic curve L21 of the aforementioned specific example. In the diagram, frequency (MHz) is plotted on the horizontal axis, attenuation (dB) for the band-pass filter characteristic curve L11 is plotted on the left vertical axis, and insertion loss (dB) for the insertion loss characteristic curve L21 is plotted on the right vertical axis.

Figure 22:
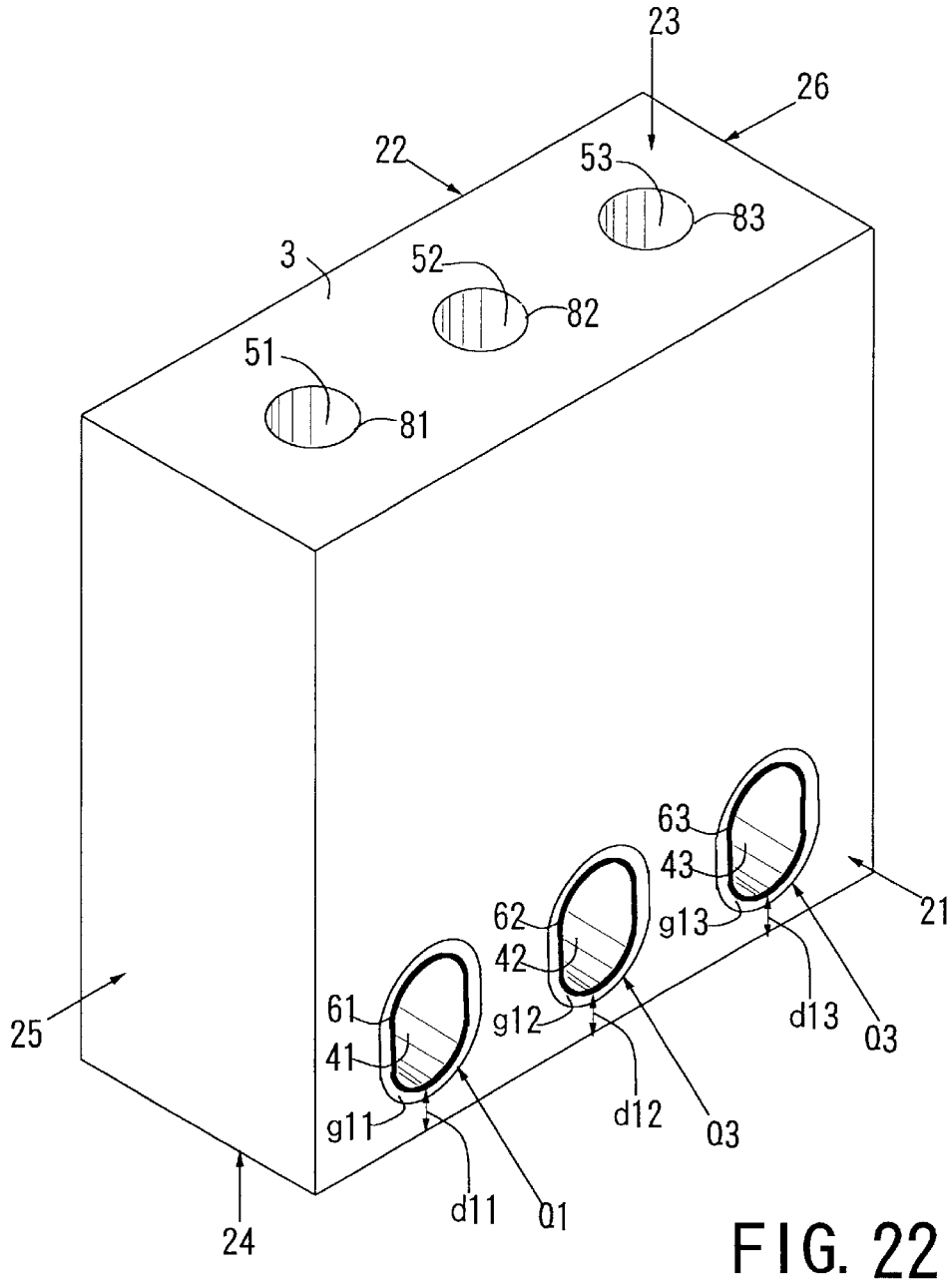
FIG. 22 is a perspective view depicting another embodiment of a dielectric filter having three resonator units.
Figure 23:
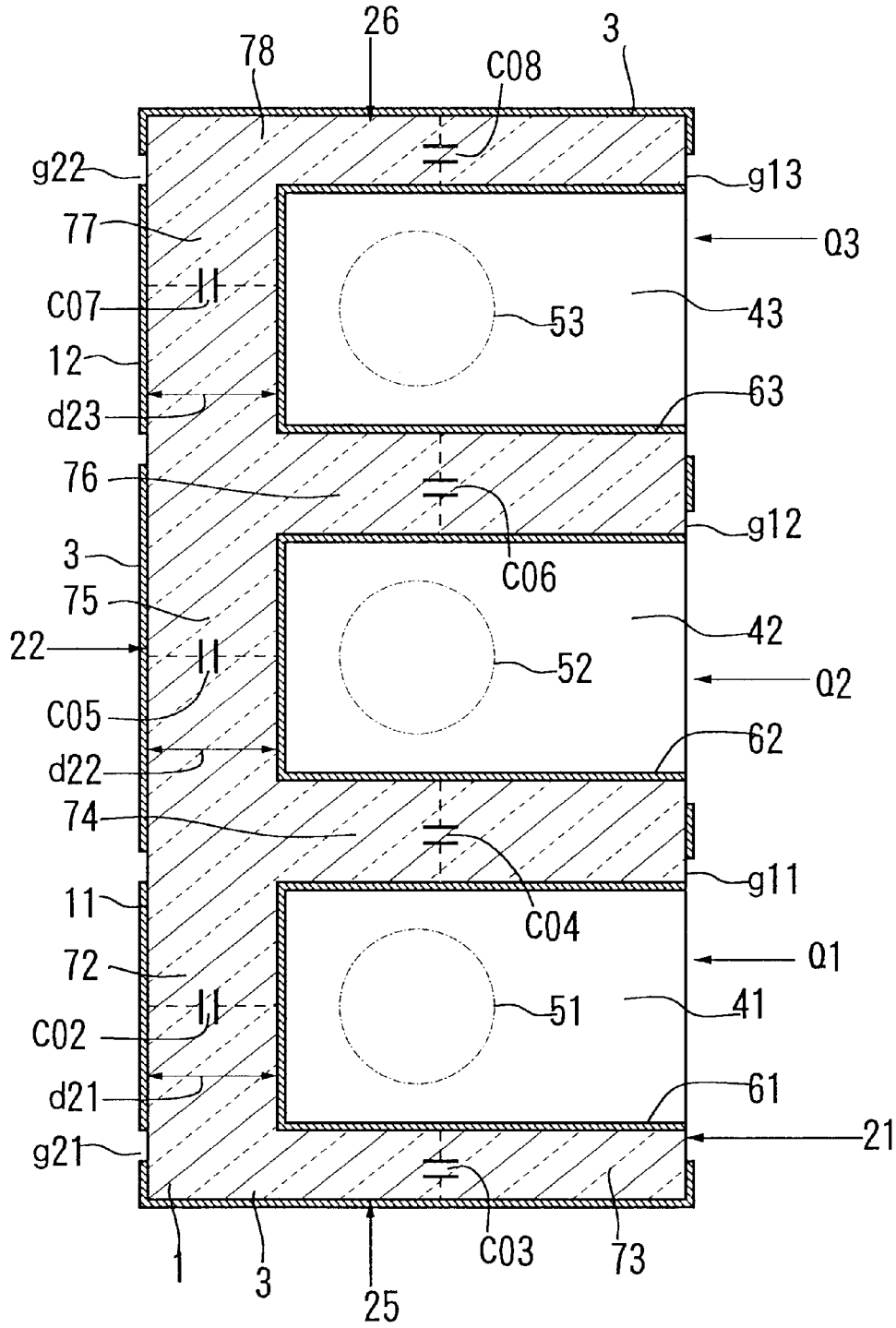
FIG. 23 is a cross-sectional view of the embodiment shown in FIG. 22 corresponding to FIG. 20.

FIG. 22 is a perspective view depicting another embodiment of a dielectric filter having three resonator units Q1, Q2, and Q3, and FIG. 23 is a cross-sectional view corresponding to FIG. 22. The basic configuration of the embodiment shown in FIG. 22 and FIG. 23 is similar to the embodiment shown in FIGS. 17 to 20, but differs in the following aspects: the structures of the resonator units Q1 to Q3 are substantially identical, the intervals between the first holes 41 to 43 of the resonator units Q1 to Q3 are larger than in FIGS. 17 to 20, and the thicknesses d11, d12, and d13 of the dielectric layer 71 equivalent to the distances between the external conductor film 3 and the first holes 41 to 43 of the resonator units Q1 to Q3 are less than in FIGS. 17 to 20.

Next, a specific example is given to describe the frequency properties of the dielectric filter shown in FIGS. 22 and 23. In the embodiment shown in FIGS. 21 and 22, the dielectric substarate 1 is given an approximately rectangular parallelepiped shape using dielectric material with a relative dielectric constant $\epsilon r$=92. The shape of the dielectric substarate 1 is set such that the area seen in the surface 23 is (4.2 mm×2 mm) and the length L1 is 2.5 mm. The diameters D2 of the second holes 51 to 53 are 0.7 mm.

In the embodiment shown in FIGS. 22 and 23, the intervals between the first holes 41 to 43 of the resonator units Q1 to Q3 are greater than in FIGS. 17 to 20, so the capacitance generated between the resonator units Q1 to Q3 is small. On the other hand, since the distances d11 to d13 between the external conductor film 3 and the first holes 41 to 43 of the resonator units Q1 to Q3 are less than in FIGS. 17 to 20, the capacitance C01 generated therein is comparatively large. Therefore, inductive coupling exists between the adjacent resonator units Q1 to Q3. This aspect is different from that of the embodiment in FIGS. 17 to 20, which exhibits capacitive coupling.

Figure 24:
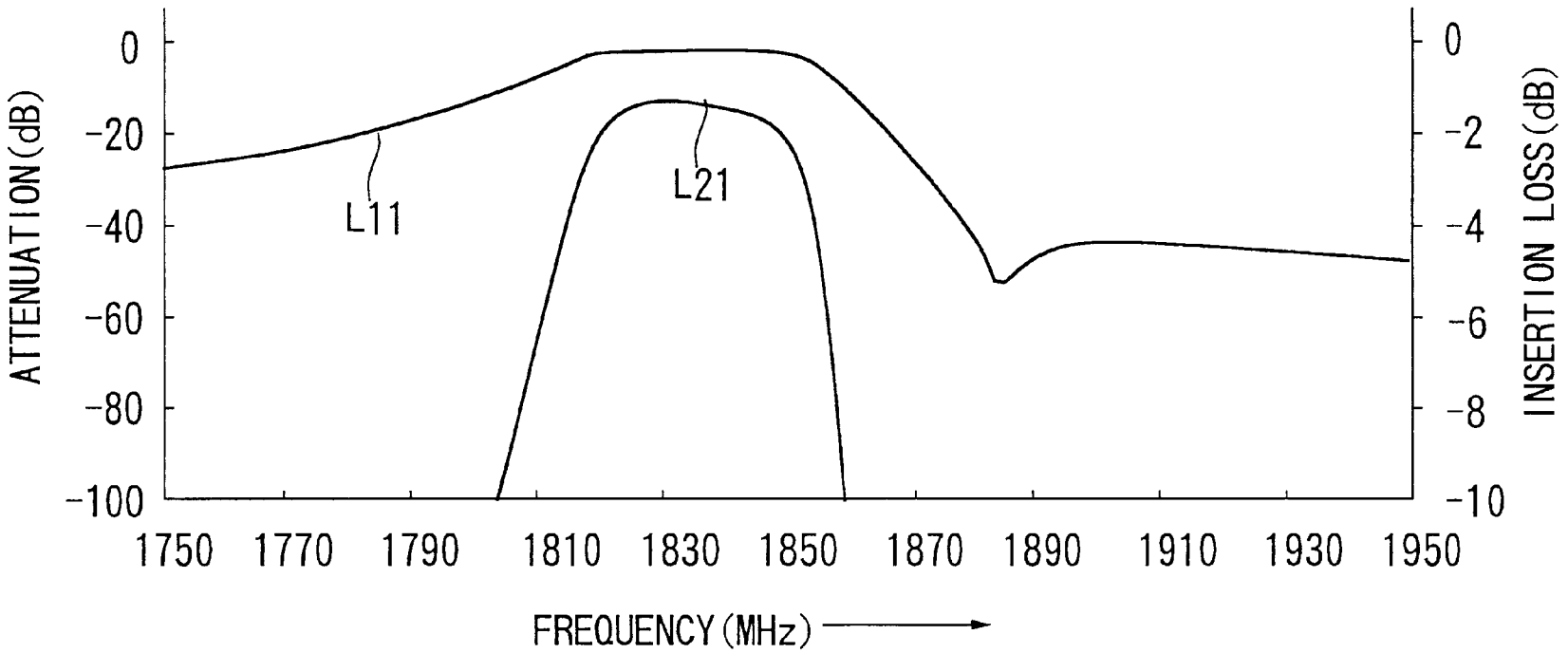
FIG. 24 is an diagram depicting the band-pass filter characteristic curve and insertion loss characteristic curve of a specific example relating to the embodiment in FIGS. 22 and 23.

FIG. 24 shows the band-pass filter characteristic curve L11 and insertion loss characteristic curve L21 of the aforementioned specific example relating to the embodiment in FIGS. 22 and 23. In the diagram, frequency (MHz) is plotted on the horizontal axis, attenuation (dB) for the band-pass filter characteristic curve L11 is plotted on the left vertical axis, and insertion loss (dB) for the insertion loss characteristic curve L21 is plotted on the right vertical axis.

The dielectric device relating to the present invention can be used as an device with extensive coverage for a dielectric resonator, a dielectric filter, or a duplexer. Dielectric resonators and dielectric filters have so far been described in detail with reference to FIGS. 1 to 24. Due to limitations of space, no further descriptions will be given, but it is self-evident that a greater number of resonator units can be provided, and that a multiple combination of the embodiments illustrated and described is possible.

Next, a duplexer will be described as another significant application example of a dielectric device relating to the present invention.

Figure 25:
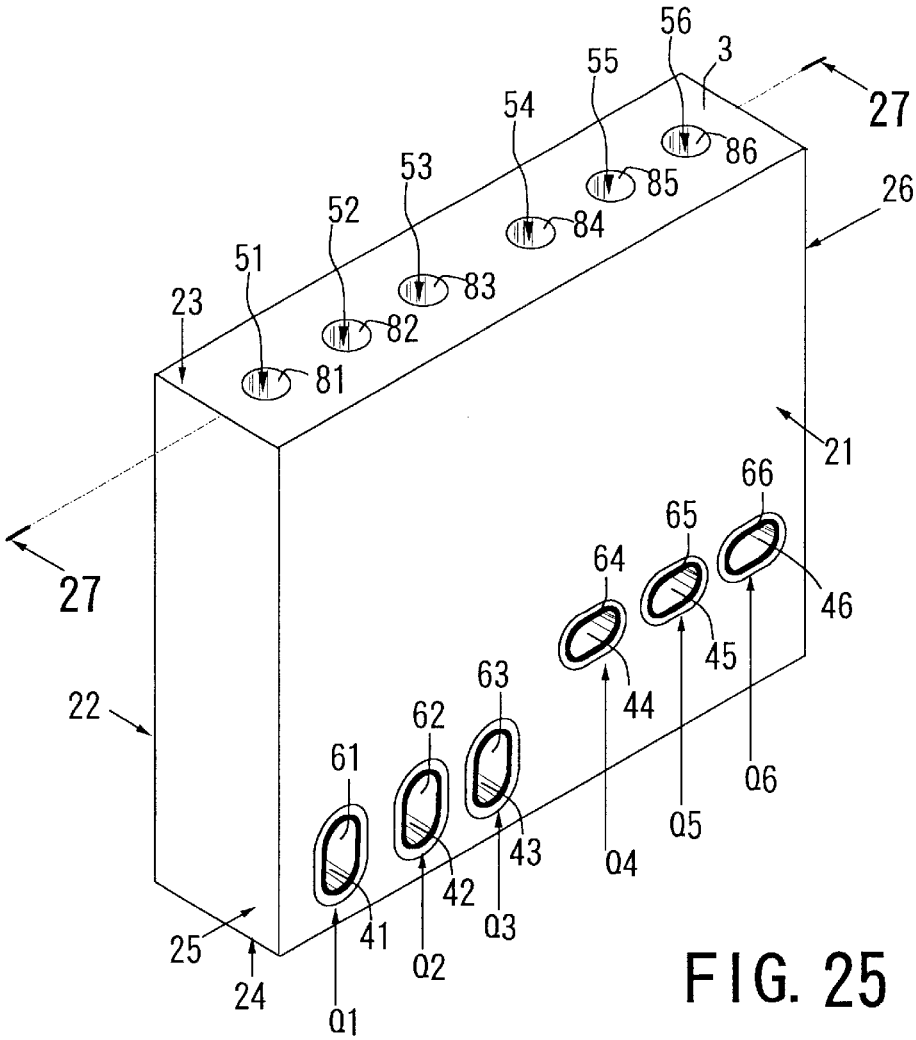
FIG. 25 is a perspective view of a duplexer relating to the present invention.
Figure 26:
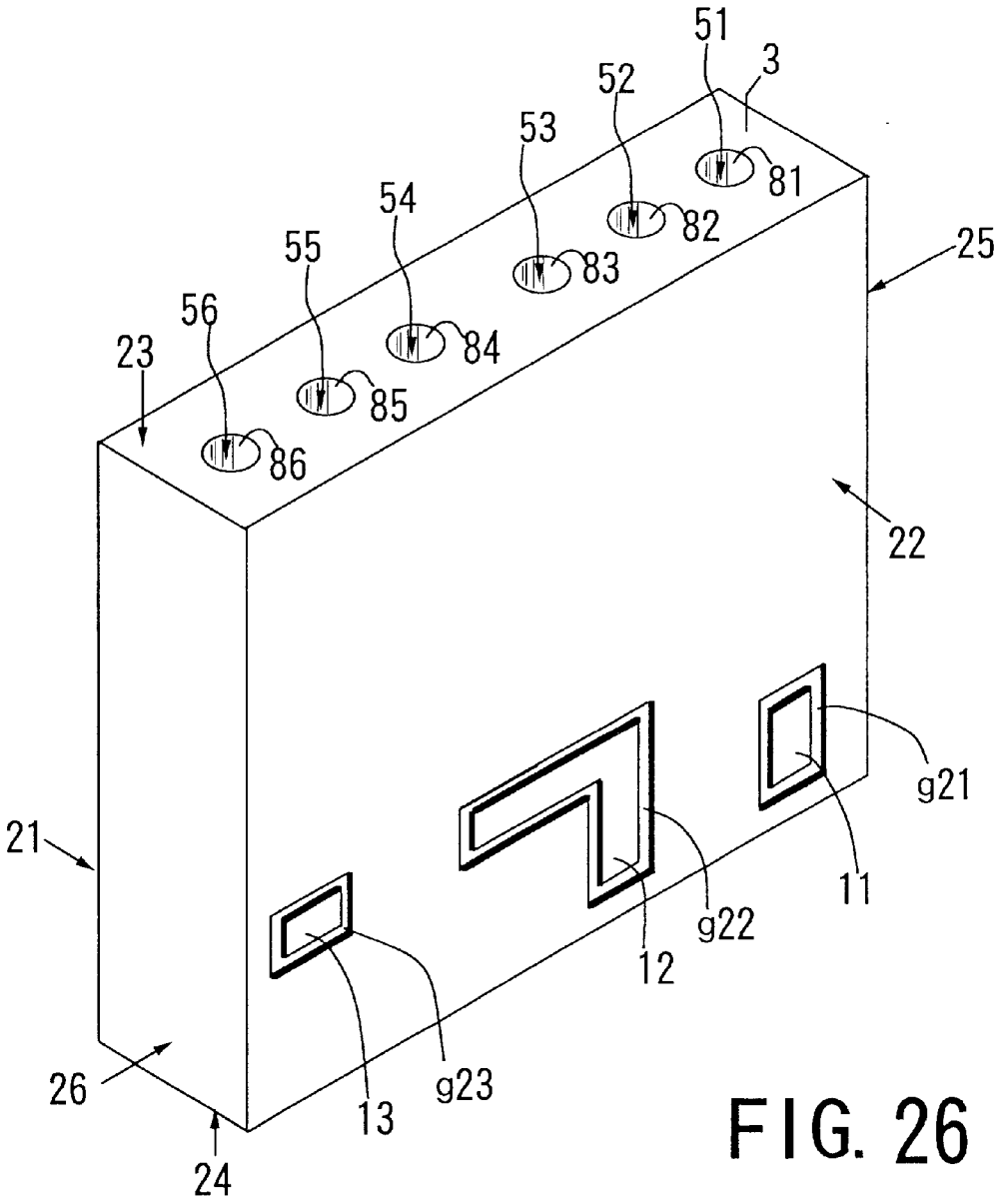
FIG. 26 is a perspective view of the duplexer shown in FIG. 25 as seen from the rear side.
Figure 27:
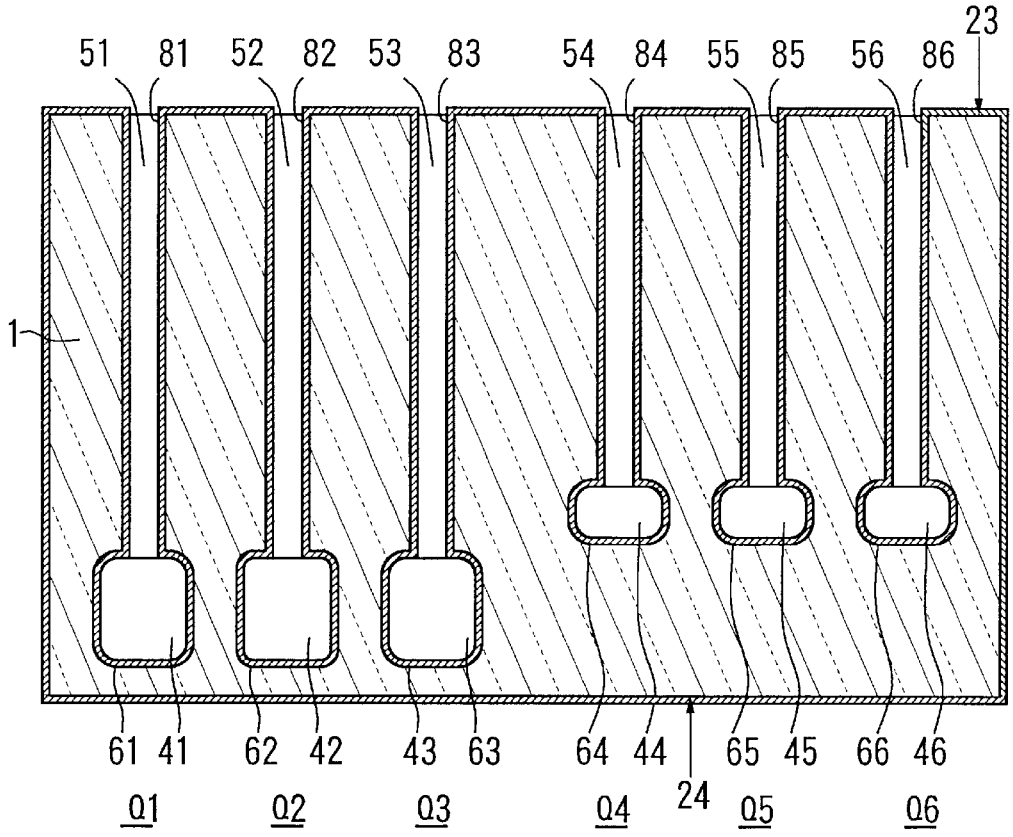
FIG. 27 is a cross-sectional view along the line 27—27 in FIG. 25.

FIG. 25 is a perspective view of a duplexer relating to the present invention, FIG. 26 is a perspective view of the duplexer shown in FIG. 25 as seen from the rear side, and FIG. 27 is a cross-sectional view along the line 27—27 in FIG. 25. The illustrated duplexer has six resonator units Q1 to Q6. The resonator units Q1 to Q6 all share the dielectric substarate 1 and are integrated via the dielectric substarate 1. In the dielectric substarate 1, the larger areas of the external surfaces except the first surface 21 (the open surface) are covered by the external conductor film 3.

Of these resonator units Q1 to Q6, the resonator unit Q1 comprises a combination of the first hole 41 and the second hole 51, the resonator unit Q2 comprises a combination of the first hole 42 and the second hole 52, and the resonator unit Q3 comprises a combination of the first hole 43 and the second hole 53. The resonator unit Q4 comprises a combination of a first hole 44 and a second hole 54, the resonator unit Q5 comprises a combination of a first hole 45 and a second hole 55, and the resonator unit Q6 comprises a combination of a first hole 46 and a second hole 56.

The details of the individual configuration and relative relationship of the first holes 41 to 46 and second holes 51 to 56 are identical to those described in FIGS. 1 to 20. The first holes 41 to 46 have the first internal conductors 61 to 66, and the second holes 51 to 56 have the second internal conductors 81 to 86.

Since the duplexer is used as a antenna duplexer, either set of resonator units Q1 to Q3 or resonator units Q4 to Q6 can be used as the transmitter, while the other set is used as the receiver. Since the transmit frequency and the receive frequency are different from each other, the resonance properties of the resonator units Q1 to Q3 and the resonance properties of the resonator units Q4 to Q6 are also different from each other.

Within the resonator units Q1 to Q3 in the transmitter end, the first terminal 11 provided to the external surface 24 is coupled with the first hole 41 of the resonator unit Q1 via the dielectric layers composed of the dielectric substarate 1.

Within the resonator units Q4 to Q6, the third terminal 13 provided to the side of the external surface 24 in the dielectric substarate 1 is coupled with the first hole 46 of the resonator unit Q6 via the dielectric layers composed of the dielectric substarate 1. The details of the capacitive coupling in this case are identical to those already described.

Furthermore, the second terminal 12 used as an antenna is connected to the first holes 43 and 44 of the middle resonator units Q3 and Q4 in the side of the external surface 24.

The first through third terminals 11 to 13 are positioned such that they are electrically insulated from the external conductor film 3 in the external surface 22 by the insulating gaps g21 to g23. The first through third terminals 11 to 13 can be used to mount the device on a mount board.

The first holes 41 to 43 of the resonator units Q1 to Q3 are elongated towards the surface 24 (in FIG. 25), and the first holes 44 to 46 of the resonator units Q4 to Q6 are elongated horizontally. The distances from the first holes 41 to 43 of the resonator units Q1 to Q3 to the external conductor film 3 are less than the distances from the first holes 44 to 46 of the resonator units Q4 to Q6. Consequently, the resonator units Q1 to Q3 exhibit an inductive coupling, and the resonator units Q4 to Q6 exhibit a capacitive coupling.

Although this is not shown in the drawings, it is obvious that each type of configuration (see FIGS. 1 to 23) illustrated by examples of a dielectric resonator or dielectric filter can also be adapted to a duplexer.

Next, a specific example will be used to describe the duplexer shown in FIGS. 25 to 27. In the embodiment shown in FIGS. 25 to 27, the dielectric substarate 1 is given an approximately rectangular parallelepiped shape using dielectric material with a relative dielectric constant $\epsilon$=92. The shape of the dielectric substarate 1 is set such that the area seen in the surface 23 is (8.5 mm×2 mm) and the length L1 is 2.5 mm. The diameters D2 of the second holes 51 to 56 are 0.6 mm.

Figure 28:
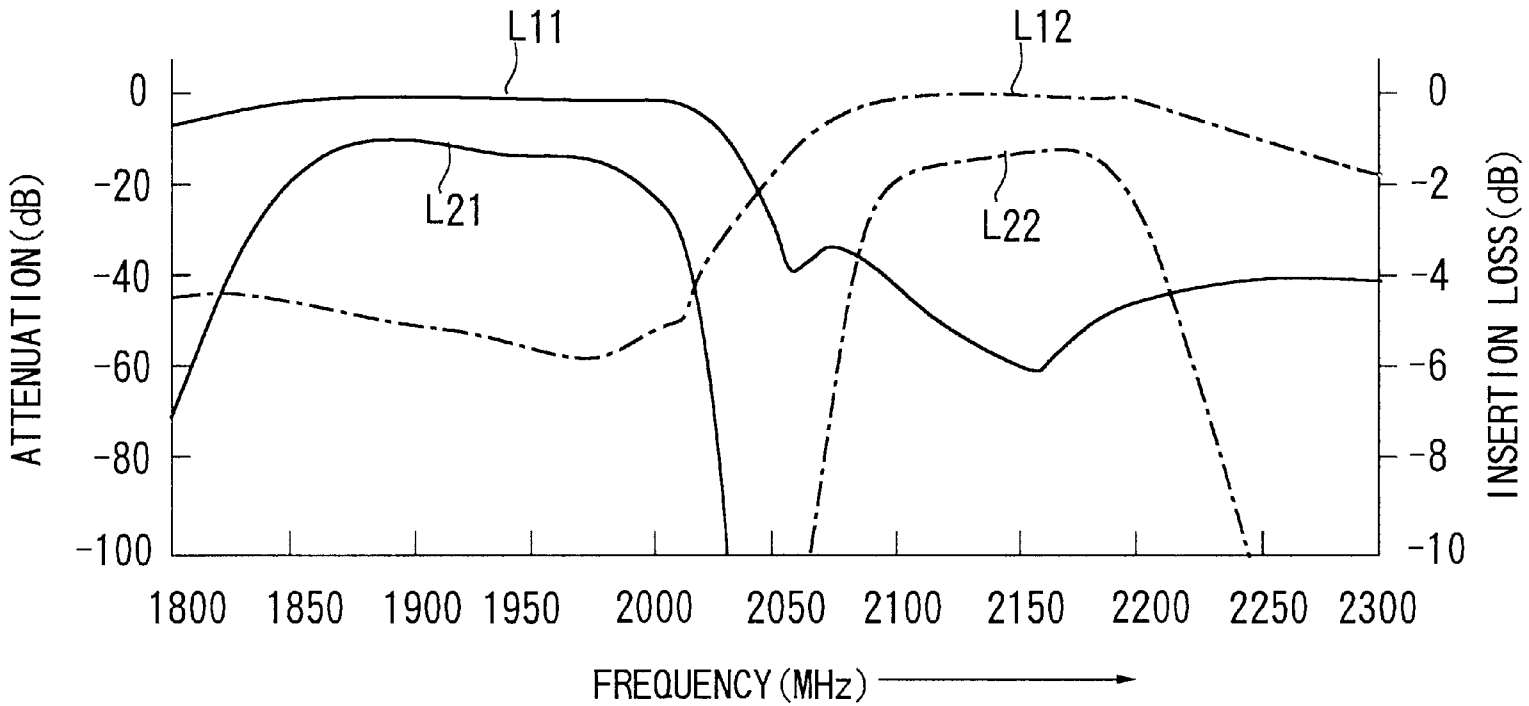
FIG. 28 depicts the frequency characteristics of a duplexer relating to the specific example shown in FIGS. 25–27.

FIG. 28 shows the frequency characteristics of a duplexer relating to the aforementioned specific example. In the diagram, frequency (MHz) is plotted on the horizontal axis, attenuation (dB) for the band-pass filter characteristic curves L11 and L12 is plotted on the left vertical axis, and insertion loss (dB) for the insertion loss characteristic curves L21 and L22 is plotted on the right vertical axis. The band-pass filter characteristic curve L11 pertain to the resonator units Q1 to Q3, and the band-pass filter characteristic curve L12 pertain to the resonator units Q4 to Q6. The insertion loss characteristic curve L21 pertain to the resonator units Q1 to Q3, and the insertion loss characteristic curve L22 pertain to the resonator units Q4 to Q6.

As described above, the resonator units Q1 to Q3 exhibit an inductive coupling and the resonator units Q4 to Q6 exhibit a capacitive coupling, so it is possible to obtain a duplexer with adequate attenuation properties in two bands when three of the resonators are used for high-frequency band-pass filters and the other three resonators are used for low-frequency band-pass filters.

The present invention is not limited to the previous specific examples. In the dielectric substarate 1 for forming the plurality of resonator units Q1 to Q6, the first holes 41 to 46 formed from the surfaces other than the surface 23 do not necessarily need to be formed from the same side surface. They may be set in any suitable side surface in compliance with the input/output terminals and with the extent of adjustment. Conductor-free sections around the first holes 41 to 46 may be either separated or integrated by the conductors according to the desired electrical properties. The other resonator units formed adjacent to the second holes 51 to 56 may be formed from the surface 24 opposing the surface 23.

As described above, the following effects can be obtained according to the present invention.

(a) It is possible to provide a dielectric device suitable for miniaturization and height reduction.

(b) It is possible to provide a surface-mountable dielectric device.

What is claimed is:

1. A dielectric device comprising a dielectric substrate, at least one resonator unit and a terminal, wherein:

the dielectric substrate has an external conductor film on a first surface and other external surfaces;

the resonator unit comprises a first hole and a second hole;

the first hole is provided to the dielectric substrate, has one end being open in the first surface, extends from the first surface toward an external surface opposite thereto, and has a first internal conductor in the interior, the first internal conductor being separated from the external conductor film on the first surface by a gap;

the second hole is provided to the dielectric substrate, opens in an external surface not opposing the first surface, connects with the first hole in the interior of the dielectric substrate, and has a second internal conductor in the interior, one end of the second internal conductor being connected to the first internal conductor in the interior of the dielectric substrate, and the other end being connected to the external conductor film;

the other end of the first hole protrudes lengthwise past the connecting area with the second hole; and the terminal is provided on the external surface of the dielectric substrate, and is electrically coupled with the first internal conductor provided at the other end of the first hole via the dielectric substrate.

2. The device according to claim 1, wherein:

there is a plurality of resonator units;

there is a plurality of terminals, which comprise a first terminal and a second terminal;

the first terminal is provided to the dielectric substrate and is electrically coupled with at least one of the resonator units; and the second terminal is provided to the dielectric substrate and is electrically coupled with at least one of the other resonator units.

3. The device according to claim 1, wherein:

there is a plurality of resonator units, and adjacent resonator units are electrically coupled by the first internal conductors via the dielectric substrate.

4. The device according to claim 3, wherein:

the resonator units comprises a step-like recess; and the recess is formed in the external surface in which the second holes open, and comprises, in common, the second holes inside thereof.

5. The device according to claim 1, wherein:

the distance between the first hole and the external surface in which the second hole opens is greater than the distance between the first hole and the surface opposing the second hole.

6. The device according to claim 1, wherein:

the first hole comprises a large opening and a small opening; and the large opening opens in the first surface, while the small opening connects with the large opening.

7. The device according to claim 1, wherein:

the second hole comprises a large opening and a small opening; and the large opening opens in the surface in which the second hole opens, while the small opening connects with the large opening.

8. The device according to claim 1, which is a dielectric filter.

9. The device according to claim 1, which is a duplexer.

10. A dielectric device comprising a dielectric substrate, at least one resonator unit and a terminal, wherein:

the dielectric substrate has an external conductor film on a first surface and other external surfaces;

the resonator unit comprises at least one first hole and a second hole;

the first hole is provided to the dielectric substrate, has one end being open in the first surface, extends from the first surface toward an external surface opposite thereto, and has a first internal conductor in the interior, the first internal conductor being separated from the external conductor film on the first surface by a gap;

the second hole is provided to the dielectric substrate, opens in an external surface not opposing the first surface, connects with the first hole in the interior of the dielectric substrate, and has a second internal conductor in the interior, one end of the second internal conductor being connected to the first internal conductor in the interior of the dielectric substrate, and the other end being connected to the external conductor film;

there is a plurality of first holes, each of which opens in a different external surface of the dielectric substrate, and is provided with a first internal conductor being connected to the second internal conductor in the interior of the dielectric substrate; and the terminal is provided on the external surface of the dielectric substrate, and is electrically coupled with one of the first internal conductors via the dielectric substrate.

11. The device according to claim 10, wherein:

there is a plurality of resonator units;

there is a plurality of terminals, which comprise a first terminal and a second terminal;

the first terminal is provided to the dielectric substrate and is electrically coupled with at least one of the resonator units; and the second terminal is provided to the dielectric substrate and is electrically coupled with at least one of the other resonator units.

12. The device according to claim 10, wherein:

there is a plurality of resonator units, and adjacent resonator units are electrically coupled by the first internal conductors via the dielectric substrate.

13. The device according to claim 12, wherein:

the resonator units comprises a step-like recess; and the recess is formed in the external surface in which the second holes open, and comprises, in common, the second holes inside thereof.

14. The device according to claim 10, wherein:

the distance between one of the first holes and the external surface in which the second hole opens is greater than the distance between the one of the first holes and the surface opposing the second hole.

15. The device according to claim 10, wherein:

one of the first holes comprises a large opening and a small opening; and the large opening opens in the first surface, while the small opening connects with the large opening.

16. The device according to claim 10, wherein:

the second hole comprises a large opening and a small opening; and the large opening opens in the surface in which the second hole opens, while the small opening connects with the large opening.

17. The device according to claim 10, which is a dielectric filter.

18. The device according to claim 10, which is a duplexer.

19. A dielectric device comprising a dielectric substrate and at least one resonator unit, wherein:

the dielectric substrate has an external conductor film on a first surface and other external surfaces;

the resonator unit comprises a plurality of first holes and a second hole;

the first hole is provided to the dielectric substrate, has one end being open in the first surface, extends from the first surface toward an external surface opposite thereto, and has a first internal conductor in the interior, the first internal conductor being separated from the external conductor film on the first surface by a gap;

the second hole is provided to the dielectric substrate, opens in an external surface not opposing the first surface, connects with the first hole in the interior of the dielectric substrate, and has a second internal conductor in the interior, one end of the second internal conductor being connected to the first internal conductor in the interior of the dielectric substrate, and the other end being connected to the external conductor film; and there is a plurality of first holes, each of which opens in a different external surface of the dielectric substrate, intersects with the end of the second hole in the interior of the dielectric substrate, and is provided with a first internal conductor being connected to the second internal conductor in the interior of the dielectric substrate.

20. The device according to claim 19, comprising a terminal, wherein:

the terminal is provided on the external surface of the dielectric substrate, and is electrically coupled with one of the first internal conductors via the dielectric substrate.

21. The device according to claim 20, wherein:

there is a plurality of resonator units;

there is a plurality of terminals, which comprise a first terminal and a second terminal;

the first terminal is provided to the dielectric substrate and is electrically coupled with at least one of the resonator units; and the second terminal is provided to the dielectric substrate and is electrically coupled with at least one of the other resonator units.

22. The device according to claim 19, wherein:

there is a plurality of resonator units, and adjacent resonator units are electrically coupled by the first internal conductors via the dielectric substrate.

23. The device according to claim 22, wherein:

the resonator units comprises a step-like recess; and the recess is formed in the external surface in which the second holes open, and comprises, in common, the second holes inside thereof.

24. The device according to claim 19, wherein:

the distance between one of the first holes and the external surface in which the second hole opens is greater than the distance between the one of the first holes and the surface opposing the second hole.

25. The device according to claim 19, wherein:

one of the first holes comprises a large opening and a small opening; and the large opening opens in the first surface, while the small opening connects with the large opening.

26. The device according to claim 19, wherein:

the second hole comprises a large opening and a small opening; and the large opening opens in the surface in which the second hole opens, while the small opening connects with the large opening.

27. The device according to claim 19, which is a dielectric filter.

28. The device according to claim 19, which is a duplexer.

* * * * *